US005673054A

United States Patent [19]

Hama

[11] Patent Number: 5,673,054

[45] Date of Patent: Sep. 30, 1997

[54] ANTENNA AND MINIATURE PORTABLE WIRELESS TRANSCEIVER

[75] Inventor: Norio Hama, Suwa, Japan

[73] Assignee: Seiko Epson Corporation, Tokyo, Japan

[21] Appl. No.: 299,335

[22] Filed: Aug. 31, 1994

Related U.S. Application Data

[63] Continuation of Ser. No. 972,452, filed as PCT/JP92/00581, May 6, 1992, published as WO92/20117, Nov. 12, 1992, abandoned.

[30] Foreign Application Priority Data

May 9, 1991 [JP] Japan ..... 3-104245
Oct. 1, 1991 [JP] Japan ..... 3-253773

[51] Int. Cl.[6] ..... H01Q 11/12

[52] U.S. Cl. ..... 343/744; 343/702; 343/748; 343/866

[58] Field of Search ..... 343/744, 702, 343/748, 745, 866, 718

[56] References Cited

U.S. PATENT DOCUMENTS

| | | | |
|---|---|---|---|
| 2,629,051 | 2/1953 | Lindenblad | 343/767 |
| 3,918,062 | 11/1975 | Haruki et al. | 343/702 |
| 4,419,770 | 12/1983 | Yagi et al. | 455/301 |
| 4,862,181 | 8/1989 | Ponce De Leon et al. | 343/866 X |
| 4,862,516 | 8/1989 | Macnak et al. | 343/718 X |
| 4,884,252 | 11/1989 | Teodoridis et al. | 368/10 |
| 4,973,944 | 11/1990 | Maletta | 340/572 X |
| 5,113,196 | 5/1992 | Ponde de Leon et al. | 343/744 |
| 5,134,418 | 7/1992 | Gomez et al. | 343/718 |
| 5,182,568 | 1/1993 | Stamps, Jr. et al. | 343/702 |
| 5,227,804 | 7/1993 | Oda | 343/856 X |
| 5,300,938 | 4/1994 | Maroun et al. | 343/702 |
| 5,408,699 | 4/1995 | Yamashita et al. | 343/702 X |
| 5,469,178 | 11/1995 | Nguyen et al. | 343/702 |

FOREIGN PATENT DOCUMENTS

| | | | |
|---|---|---|---|
| 0 122 485 | 10/1984 | European Pat. Off. | 343/866 |
| 0 372 430 | 6/1990 | European Pat. Off. | H01Q 1/27 |
| 0565725 | 10/1993 | European Pat. Off. . | |
| 55-12762 | 4/1980 | Japan . | |
| 56-27514 | 3/1981 | Japan . | |
| 59-44103 | 3/1984 | Japan . | |
| 61-200702 | 9/1986 | Japan . | |
| 61-50542 | 11/1986 | Japan . | |
| 62-24705 | 2/1987 | Japan . | |
| 3-88404 | 4/1991 | Japan . | |
| 3181208 | 7/1991 | Japan . | |

OTHER PUBLICATIONS

Webster's II New Riverside University Dictionary, p. 827 1988.

Hama et al, "A Study on Small Slot Antenna for Wrist Watch Type Portable Radio Equipment," Technical Report IEICE, No Date, pp. 1–13.

Fujimoto et al., "Small Antennas"; Research Studies Press, Ltd.; John Wiley & Sons, Inc., 1987.

Ito et al.; "A Small–Loop Antenna for Pocket–Size VHF Radio Equipment", National Technical Report; vol. 19, No. 2, Apr. 1973; pp. 145–154.

*Primary Examiner*—Donald T. Hajec
*Assistant Examiner*—Tho Phan
*Attorney, Agent, or Firm*—Oliff & Berridge

[57] ABSTRACT

A loop antenna device of the invention, when incorporated in a transceiver, stably a high level of sensitivity without being substantially influenced by the body, regardless of the posture or direction of the transceiver when the transceiver is mounted on or carried by the human body. The loop antenna device also provides, when the transceiver is not carried on a human body, a highly stable sensitivity characteristic even in such a condition that the polarization plane changes over time under the influence of multi-path strain or fading. The antenna circuit which provides these advantageous effects does not require any additional element for matching and contributes to reduction in the size of a transceiver.

36 Claims, 15 Drawing Sheets

ANTENNA AND MINIATURE PORTABLE WIRELESS TRANSCEIVER

This is a Continuation of application Ser. No. 07/972,452 filed as PCT/JP92/00581, May 6, 1992, published as WO92/20117, Nov. 12, 1992, now abandoned.

FIELD OF THE INVENTION

The present invention relates to a miniature portable wireless transmitter/receiver (referred to as transceiver, hereinafter) and, more particularly, to an antenna and an antenna circuit system incorporated in such a transceiver.

BACKGROUND ART

Loop antennas have been widely used as antenna of miniature wireless portable transceivers, and advantages of this type of antenna are reported in an article entitled LOOP ANTENNA FOR MINIATURE WIRELESS TRANSCEIVER: National Technical Report Vol. 19 No. 2, April 1973. An antenna system also has been known in which a reactance element having a specific reactance value is fixed to an intermediate portion of a loop antenna. When signals transmitted and received are of comparatively high frequencies, an antenna known an inverse-F antenna is used besides a loop antenna.

The transmission/receiving characteristics of a miniature portable wireless transceiver are largely affected by the body of the user who carries the transceiver. A typical example of the miniature portable wireless transceivers is a device called a selective-call receiver (pager). One of the circuit components which affects the receiving sensitivity is the antenna. A loop antenna is generally used as the antenna of the pager.

In general, a loop antenna efficiently detects magnetic field components so as to provide a 6 dB improvement in the gain when the loop antenna is held at a certain azimuth with respect to the front side of the human body. This phenomenon is described in the aforementioned article and is well known. The loop antenna, however, is ineffective and reduces the gain when it is oriented in an azimuth different from that mentioned above. The loop antenna, even when it is not carried by the human body, efficiently receives waves having polarization planes of a specific azimuth but extremely deteriorates its receiving characteristics for waves having different directions of polarization planes.

This means that the receiving sensitivity is inconveniently varied according to the posture or azimuth of the transceiver.

The aforementioned article teaches that, by arranging the loop antenna element and the earth surface presented by the substrate of the transceiver orthogonally to each other, it is possible to detect both magnetic field component and electric field component, thereby reducing directivity variation caused by change in the posture of the transceiver. This type of transceiver, however, causes a 7 dB reduction in the sensitivity as an average when it is carried by a human body in such an azimuth as to detect the electric field component.

It is said that this type of transceiver exhibits a 5 dB increase as an average when carried by a human body in such an azimuth as to detect the magnetic field component. Actually, however, the electric field also is detected slightly so that the increase in the sensitivity is reduced to 3 dB or so due to its closeness to the human body. Thus, the known transceivers of the type described do not make effective use of the effect produced by the human body.

The known transceivers also suffer from a disadvantage in that, when the transceiver is not carried by a human body, the characteristics of the transceiver are periodically deteriorated in terms of time or distance due to variation of the polarization plane under the influence of multi-path or fading.

Furthermore, when the loop antenna itself has a length which is not negligible with respect to the wavelength of the signal used, the impedance of the antenna is locally increased and lowered and, when a portion having a large impedance approaches the human body or a substance having a large dielectric constant, the impedance is deviated to cause a mismatch, with the result that the transmission/receiving sensitivities are lowered.

SUMMARY OF THE INVENTION

An object of the present invention is to provide an antenna which can improve transmission/receiving sensitivities of a transceiver, thereby overcoming the above-described problems of the prior art.

According to the present invention, there is provided a loop antenna device for use in a portable transceiver having the loop antenna device, a wireless transmission/receiving circuit, a data decoder, a CPU, a data display means and an informing circuit, the loop antenna device comprising:

a first loop portion and a second loop portion which in cooperation form a loop antenna, the first loop antenna having one terminal connected to a first variable capacitance means and the other terminal connected to one of the terminals of a second variable capacitance means, the second loop portion having one terminal connected to the other terminal of the second variable capacitance means and the other terminal connected to a high-frequency grounded surface of a substrate.

The high-frequency grounded surface may have a rectangular form the shorter sides of which extend along the longer sides of the loop antenna device while the longer sides of the rectangular form extend perpendicularly to the longer sides of the loop antenna device.

Each of the first and second variable capacitance means may be adapted to change its capacitance as a result of application of a voltage across the variable capacitance means.

The value of the ratio of the capacitance of the second variable capacitance means to the capacitance of the first variable capacitance means is nearly equal to the ratio of the length of the first loop portion to the length of the second loop portion.

The voltage applied to the variable capacitance means may be varied in accordance with the posture of the portable transceiver.

The loop antenna device may further comprise a switch which changes over the voltage in accordance with the posture of the portable transceiver.

The invention also provides a portable transceiver incorporating the loop antenna device set forth hereinbefore.

The invention also provides a loop antenna device for use in a miniature portable transceiver having the loop antenna device, a wireless transmission/receiving circuit, a data decoder, a CPU, a data display means and an informing circuit which are encased in a casing, the loop antenna device comprising a board mounting a circuit for operating the portable transceiver, the board having a length ranging between 1/10 and 1/6 the wavelength of the received/transmitted wave and is provided with an open area in the direction perpendicular to the longitudinal direction, thus forming a loop antenna having a length ranging between 1/10 and ⅙ the wavelength of the wave received/transmitted by the transceiver.

Preferably, the loop antenna has a length nearly the same as the length of the board.

The invention also provides a portable transmitter incorporating the loop antenna device of the type described.

The antenna device may be divided at a position which is between 6:1 and 8:1 of the overall length thereof into a first loop portion having a greater length and a second loop portion having a smaller length, the first loop portion being connected at its one terminal to a common potential pattern of the transceiver and at its other terminal to one terminal of the second loop portion through a capacitive reactance means.

Preferably, the length of the circuit board is nearly equal to the sum of the lengths of the first loop portion and the second loop portion.

The invention also provides a loop antenna device for use in a portable transceiver having the loop antenna device, a wireless transmission/receiving circuit, a data decoder, a CPU, a data display means and an informing circuit which are encased in a casing, wherein the loop antenna device has a slit.

The loop antenna device may further comprise a capacitive reactance means which interconnects certain points on two conductor plates which oppose each other across the slit.

One of two conductor plates facing each other across the slit may be connected at a certain point thereof to a common potential pattern of the wireless transmitting/receiving circuit.

The other of the two conductor plates may be connected at a certain point thereof to a high-frequency input terminal of the wireless transmitting/receiving circuit.

The loop antenna device may further have another capacitive reactance means so as to be formed in two pairs across the another capacitive reactance means.

The capacitive reactance means may be disposed on the loop antenna device at positions opposite to each other with respect to the center of the slit.

The invention further provides a portable transceiver incorporating a loop antenna device of the type set forth above.

DETAILED DESCRIPTION OF THE PREFERRED EMBODIMENTS

Figure 1:
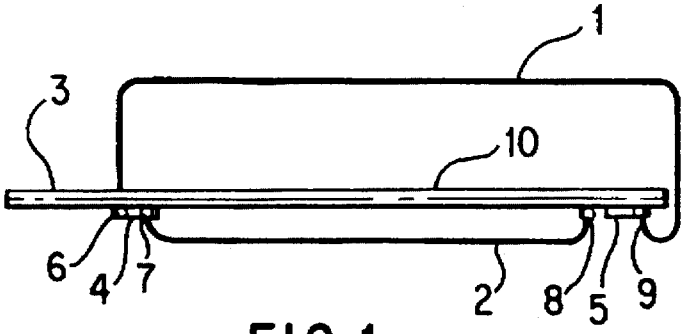
FIG. 1 is a sectional view of an antenna device of the present invention as viewed from the open side thereof.

The invention will be described in detail with reference to the accompanying drawings, FIG. 1 is a sectional view of an antenna device of the present invention as viewed from an open side thereof. A first loop portion 1 and a second loop portion 2 are connected to each other through a second variable capacitance element 4 at points 6 and 7. The second loop portion 2 is connected at the connecting point 8 to an inner printed pattern 10 which spreads over the entire area of the circuit board 3. The other terminal of the first loop portion 1 is connected to a first variable capacitance element 5 via a connecting point 9. Although not shown in this Figure, a high-frequency amplifier circuit is connected to the other terminal of the first variable capacitance element 5. A single turn of loop antenna is thus formed.

Figure 2:
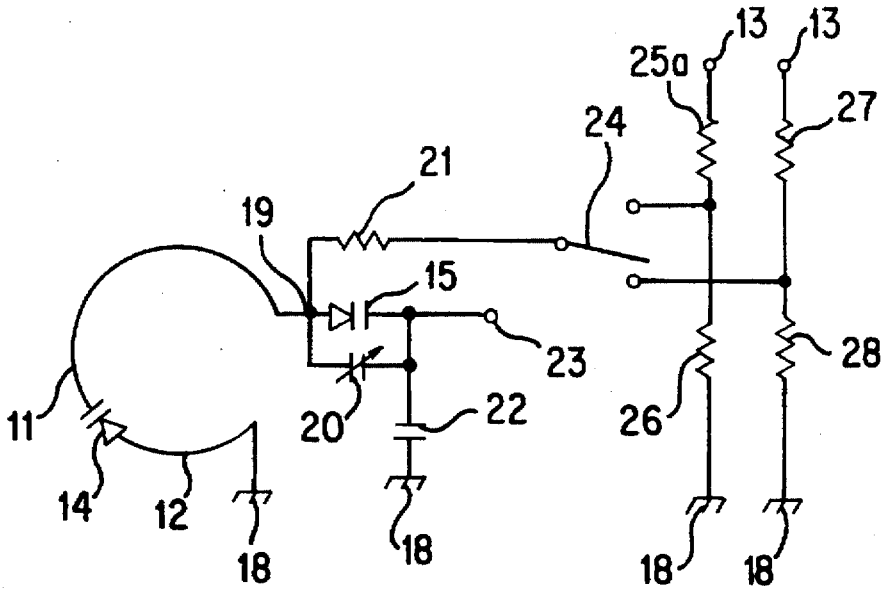
FIG. 2 is an illustration of an antenna circuit including the antenna device of the present invention.

FIG. 2 is a circuit diagram showing a circuit including the antenna device of the invention. Variable capacitance diodes 14 and 15 respectively correspond to the variable capacitance elements 4 and 5. A manual variable capacitor 20 is connected in parallel with the first variable capacitance diode 15 and a capacitor 22 is connected between the ground or earth 18 and the point of connection between the diode 15 and the variable capacitor 20. The earth 18 provides the D.C. potential of the inner printed pattern 10 shown in FIG. 1. With this arrangement, an LC resonance circuit is formed by the loop antennas 11, 12, variable capacitance diodes 14, 15, variable capacitor 20 and the capacitor 22. The LC resonance circuit resonates at a target frequency. Numeral 23 denotes a terminal for the connection to the high-frequency amplifier circuit. The variable capacitor 20 is used to provide an impedance matching so as to maximize the sensitivity of the transceiver.

A D.C. current is applied to the connection point 19 through the resistor 21. The resistor 21 has a resistance value which is high and which does not cause reduction of Q value of the antenna. The resistor 21 is connected to a change-over switch 24 which changes conducting terminals according to the posture of the transceiver. Two D.C. voltages applied to the switch 24 are determined by resistors 25*a*, 26, 27 and 28. The power supply terminal 13 is connected to a power supply for driving the transceiver circuit.

Voltages are set so that the highest potential appears at the terminal 23 and the ground level appearing at the earth 18, with the connecting point 19 set to an intermediate level. Consequently, inverse voltages are applied to the variable capacitance diodes 14, 15 and, when the voltage at the connecting point 19 is varied within the range which does not exceed the voltage of the terminal 23, two combinations of the values of the diodes 14 and 15 become available. Both combinations provide an equal impedance characteristics of the loop antennas 11, 12 as viewed from the terminal 23, so that the impedance matching at the received frequency does not change and, hence, reduction in the sensitivity due to impedance mismatching is avoided.

According to the invention, two different values are set as the ratio of the capacitance between the variable capacitance diodes 14 and 15, so as to enable the current distribution on the loop antenna to be varied to control the detection amount of the electric field component, thereby preventing variation in the sensitivity attributable to the posture of the transceiver when the transceiver is mounted on the human body.

Figure 3:
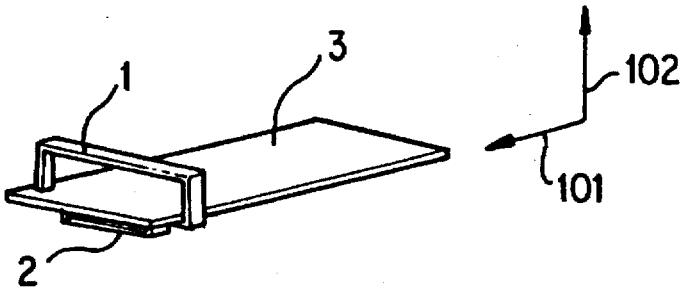
FIG. 3 is a perspective view of the arrangement of the loop antenna device in accordance with the present invention.

FIG. 3 is a perspective view of a loop antenna device of the present invention, illustrating how the loop portion is arranged. The loop antenna 1 is disposed along the shorter side of a circuit board 3. With this arrangement, the loop portions 1 and 2 serve as an antenna for detecting magnetic field, while an inner printed pattern 10 of the circuit board 3 in cooperation with the loop portions 1, 2 serves as an antenna for detecting electric field. It is assumed that a wave received has a magnetic field component 101 and an electric field component 102 which are related to each other as illustrated in FIG. 3. In such a case, the loop antenna device operates as a magnetic field antenna alone when it takes such a posture that the shorter side of the circuit board 3 extends along the electric field component 102 (this posture will be referred to as "laid-down position", hereafter) while the change-over switch 24 is located at a predetermined position, whereas, when the antenna device is in such a posture that the longer side of the circuit board 3 extends in the direction of the electric field component 102 (this posture will be referred to as "upright" position, hereafter), it serves as an antenna sensitive both to electric and magnetic fields. The antenna device also serves as an electric/magnetic field antenna when it is set in the posture as illustrated in FIG. 3.

Figure 4A:
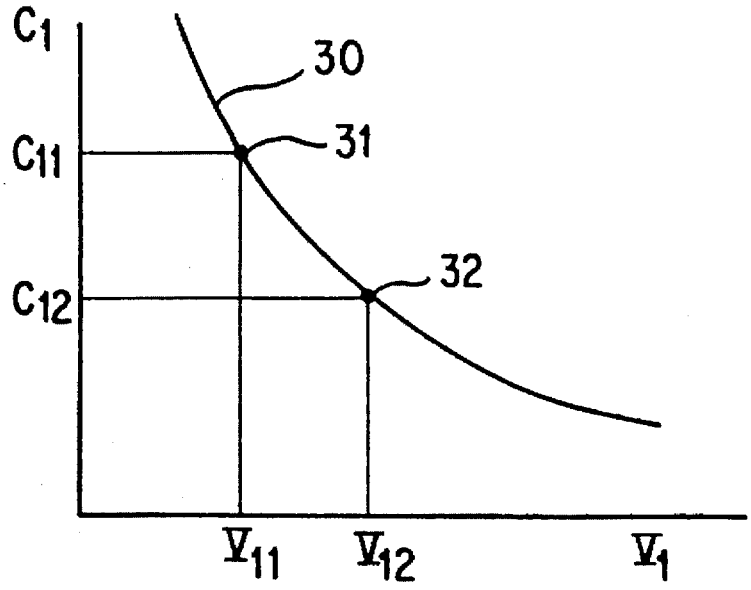
FIGS. 4(*a*) and 4(*b*) are diagrams showing changes of capacitance values of variable capacitance diodes 14, 15 shown in FIG. 2 in relation to voltage applied to these variable capacitance diodes FIGS. 5(*a*) and 5(*b*) are illustrations of directivity characteristics of the antenna device as observed when the antenna is carried by a human body.
Figure 4B:
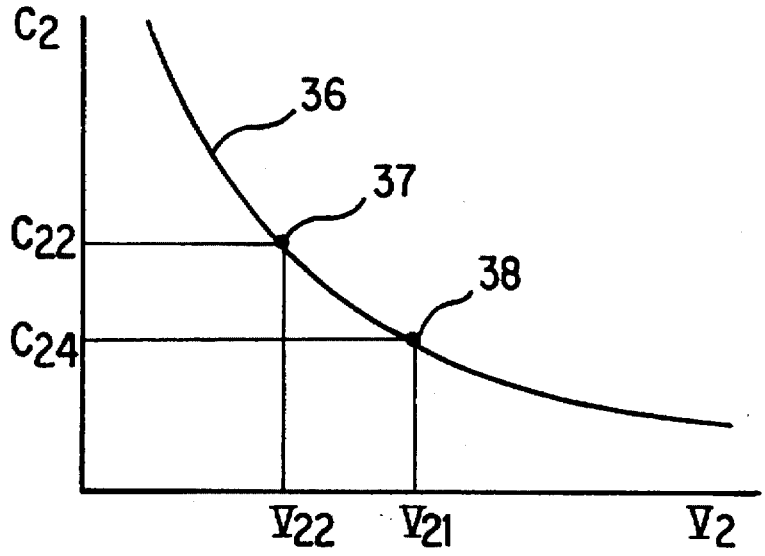

FIGS. 4(*a*) and 4(*b*) respectively are graphs showing changes in the capacitance values of the first and second variable capacitance diodes 15 and 14 in relation to voltages applied thereto. The relationship between capacitance and voltage applied to diodes 15 and 14 are respectively illustrated by lines 30 and 36. By adjusting the values between the LC resonance circuit containing the inductance of the first loop portion and the first capacitance (L1*C1) and the LC resonance circuit containing the inductance of the second loop portion and the second capacitance (L2*C2), it is possible to determine whether the substrate serves as an antenna. When the loop antenna device is in the laid-down position, the diodes 15 and 14 are respectively set at points 32 and 37. In this state, the capacitances of the first and second variable diodes, together with capacitances of the variable capacitor 20 and the capacitor 22, form a composite capacitor which resonates with the loop antennas 11 and 12 at the frequency of the received signal. Therefore, the substrate does not serve as an antenna because the condition (L1*C1=L2*C2) is satisfied. In the laid-down position, the loop can detect the magnetic field of a vertical polarization wave. With respect to a horizontal polarization wave and considering the influence affected by the human body, the electric field component of the wave cannot be detected because the substrate does not serve as an antenna. Thus, the loop antenna device operates as a magnetic field antenna and does not operate as an electric field antenna when such a capacitance ratio is attained.

When the antenna device is set in the upright position, the switch 24 is changed over so that the diode 15 and the diode 14 are respectively set to points 31 and 38. Resonance takes place also in this state at the same frequency of the received signal. Therefore, the substrate detects the electric field, because the condition (L1*C1*L2*C2) is satisfied. In the upright position, the substrate detects the electric field of a vertical polarization wave and the loop detects the magnetic field of a horizontal polarization wave. Thus, with this capacitance ratio, the antenna device serves as an electric field antenna and also as a magnetic field antenna.

Thus, in this embodiment, the antenna device operates as a magnetic field antenna alone when it is set in the laid-down position. This is intended for obtaining a greater increase in the sensitivity when mounted on the human body. In addition, the antenna device of this embodiment serves also as an electric field antenna when it is set in the upright position. This is intended to compensate for any reduction in the sensitivity which may occur when the antenna device is carried by a human body while suppressing variation in the sensitivity caused by a change in the posture of the transceiver.

When the antenna device is in the laid-down position, the capacitance ratio between the first and second variable capacitance diodes 15 and 14 are expressed by C12:C22. This value is determined to coincide with the ratio of the length between the second loop antenna 12 and the first loop antenna 11. In this state, the internal pattern 10 of the substrate and the loop antenna 12 function as a magnetic field antenna alone, without working as an electric field antenna. When the antenna device is set in the upright position, the capacitance ratio is set to C11:C21 in the illustrated case. By varying this ratio, it is possible to vary the efficiency of the antenna device as an electric field antenna, thus attaining an operation characteristic suitable for use on the human body.

Figure 5A:
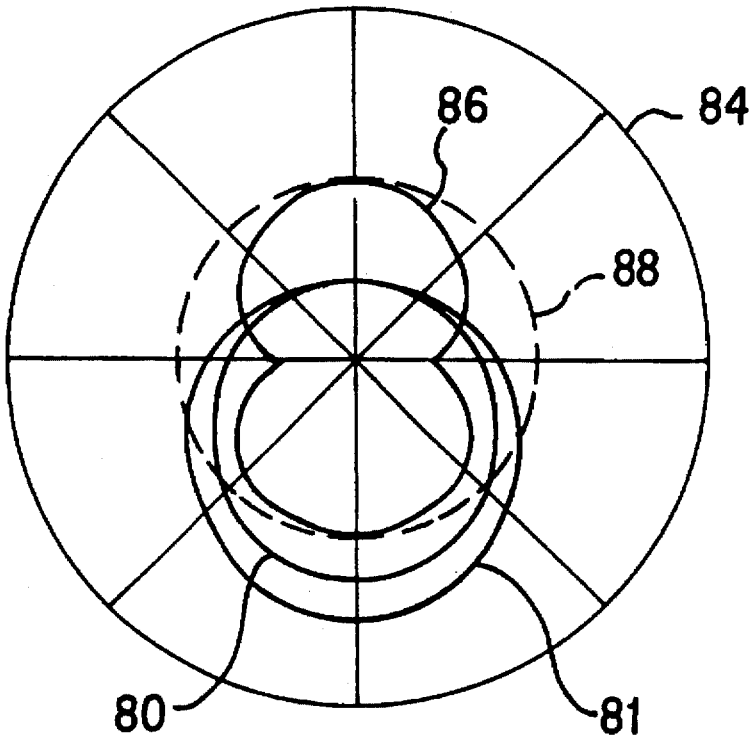
Figure 5B:
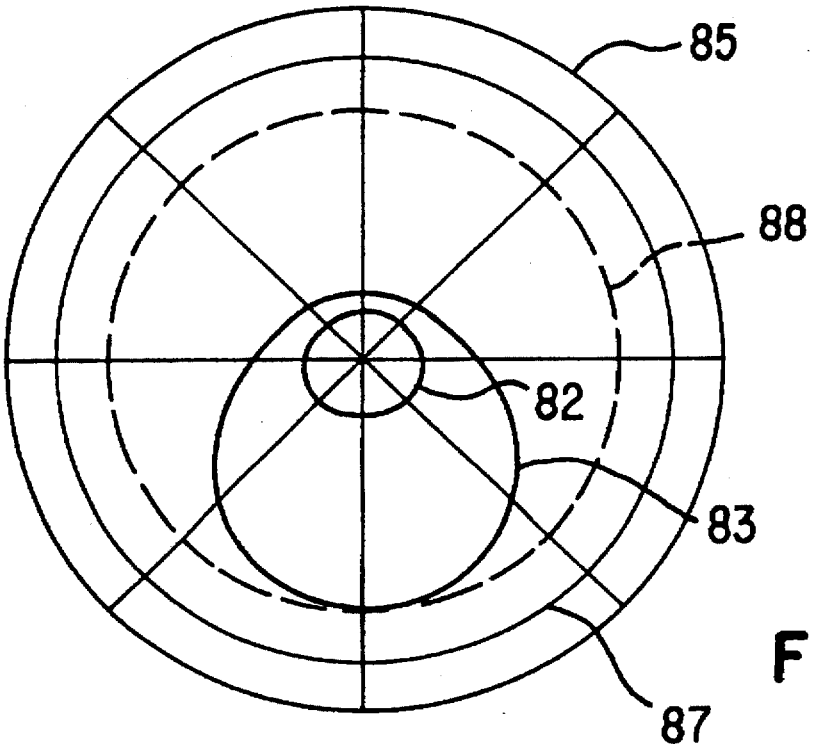

FIGS. 5(*a*) and 5(*b*) illustrate directivity characteristics of the antenna device obtained when the device is carried by a human body in the laid-down position and upright position, respectively. More specifically, in FIG. 5(*a*), using an eight-direction chart 84, a graph 80 shows the directivity characteristic as obtained when the antenna device serves as a magnetic/electric field antenna, a graph 81 shows the directivity characteristic as obtained when the antenna device functions as a magnetic field antenna alone, and a graph 86 shows the directivity characteristic as obtained when the antenna device serving as the magnetic field antenna alone is placed in a space. The graph 86 also shows characteristics as obtained when the antenna device serving electric/magnetic field antenna is placed in space. There is a large difference in the front sensitivity between the graph 81 and the graph 86. It will be seen that the effect of the human body can be utilized more effectively so that the front sensitivity characteristic of the antenna device used on a human body can be improved when the antenna device is used as the magnetic field antenna. Numeral 88 denotes a reference sensitivity level which indicates the front sensitivity of the graph 86. Referring now to FIG. 5(*b*), using an eight-direction chart 85 a graph 83 shows the directivity characteristic as observed when the antenna device is used as a magnetic/electric field antenna, a graph 82 shows the sensitivity characteristic as obtained when the antenna device operates as a magnetic field antenna alone, and a graph 87 shows the sensitivity characteristic as observed when the antenna device serving as a magnetic/electric field antenna is placed in space. The antenna device operating as an electric field antenna shows a reduction in the front sensitivity characteristic when mounted on a human body but exhibits front sensitivity characteristic exceeding the reference sensitivity level 88 in FIG. 5(*a*).

From these facts, it is understood that the antenna device of this embodiment serves as a magnetic field antenna alone when set in the laid-down posture but operates, when set in the upright position, as a magnetic/electric field antenna so as to provide a stable characteristic in whatever posture it may be mounted on the human body. In addition, the antenna device of this embodiment provides a high sensitivity regardless of any variation in the polarization plane, even if it is placed alone, provided that it is allowed to operate as a magnetic/electric field antenna.

Figure 6:
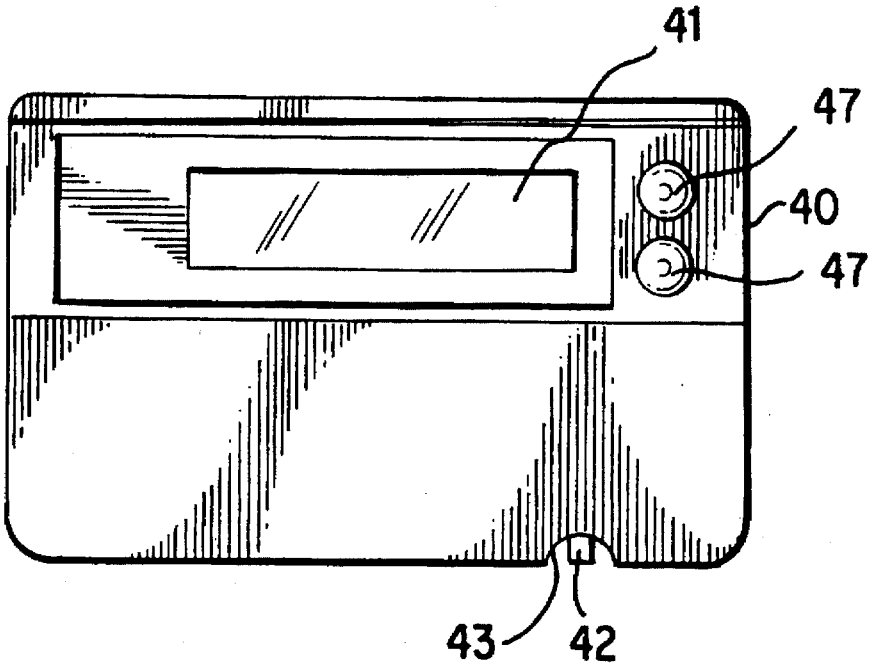
FIG. 6 shows a transceiver equipped with an antenna device of the present invention.

FIG. 6 shows the appearance of a transceiver having the antenna device of the present invention. A display panel 41 provided on the upper central portion of the main body 40 displays the content of the signal receive, time and so forth. Switches 47 are provided for the purpose of switching the content of the display on the display panel 41. A switch 42 provided on the bottom of a recess 43 formed in the lower portion of the main body detects the posture of the transceiver.

Figure 7:
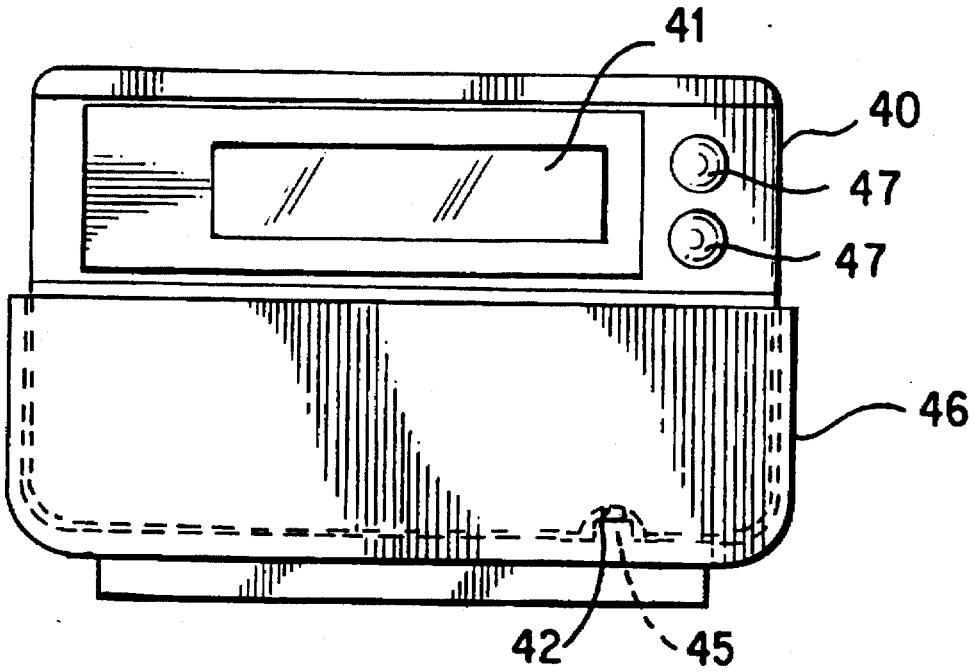
FIG. 7 is an illustration of a transceiver of FIG. 6 held in a holster.

FIG. 7 shows the transceiver of FIG. 6 held in a holster. The holster denoted by 46 is a case which is adapted to be suspended from a waist belt to enable the user to carry the transceiver. The holster 46 is provided at its bottom with a projection 45 which engages with the switch 42 of the transceiver when the transceiver is inserted into the holster. This switch 42 corresponds to the change-over switch 24 shown in FIG. 2, so that the loop antenna device operates as a magnetic field antenna alone when the switch 42 is pushed as a result of insertion of the transceiver into the holster 46. When the transceiver is taken out of the holster, however, the switch 42 is released so that the loop antenna device operates as a magnetic/electric field antenna. The transceiver also may be held in a breast pocket. In such a case, the loop antenna device serves as an electric field antenna so that no reduction in the sensitivity is caused. As will be clear also from FIG. 5, the switch 24 is opened when the transceiver alone is placed in a space, so that the loop antenna device functions as a magnetic/electric field antenna, whereby stable sensitivity characteristic is obtained regardless of the posture.

Figure 8A:
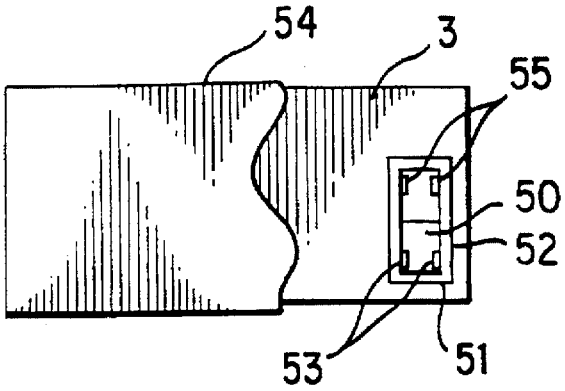
FIGS. 8(*a*) and 8(*b*) are illustrations of a transceiver of the present invention equipped with an antenna device of the present invention and incorporating a mercury switch for detecting the posture of the transceiver.
Figure 8B:
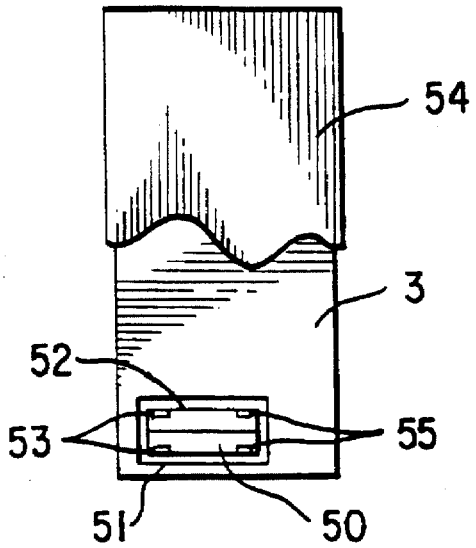

FIGS. 8(*a*) and 8(*b*) show an embodiment in which a transceiver incorporating the antenna device of the present invention is provided with a mercury switch for detecting the posture of the transceiver. According to this method, the mercury switch serves as the change-over switch 24 shown in FIG. 2 so that the mode of the antenna device is determined depending on whether the mercury switch is conductive or not conductive. More specifically, referring to FIG. 8(*a*), the transceiver 54 is held in a laid-down state so that the mercury switch 51 stands upright. In this state, a mercury column 50 which occupies 50% the internal volume of a cylinder 52 does not provide electrical connection between electrodes 53 and 55 which are provided on both ends of the cylinder 52. In this state, the antenna device serves only as a magnetic field antenna. Referring now to FIG. 8(*b*), when the transceiver is set in the upright position, the mercury switch 51 is laid horizontally so that the mercury 50 interconnects the electrodes 53 and 55. In this case, therefore, the antenna device operates as a magnetic/electric field antenna. The characteristics of the antenna during the operation are the same as those explained before in connection with FIG. 7.

Figure 9A:
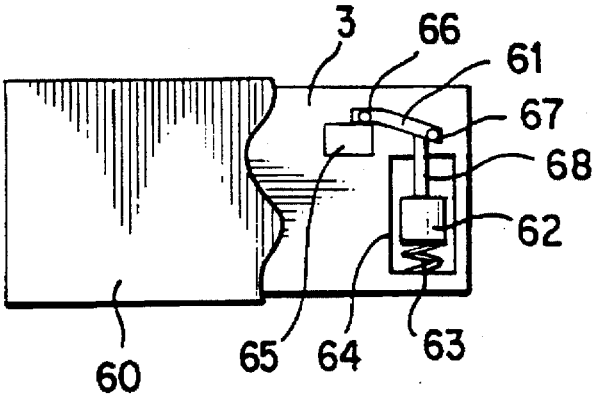
FIGS. 9(*a*) and 9(*b*) are illustrations of a transceiver of the present invention equipped with an antenna device of the present invention and incorporating a load cell for detecting the posture of the transceiver.
Figure 9B:
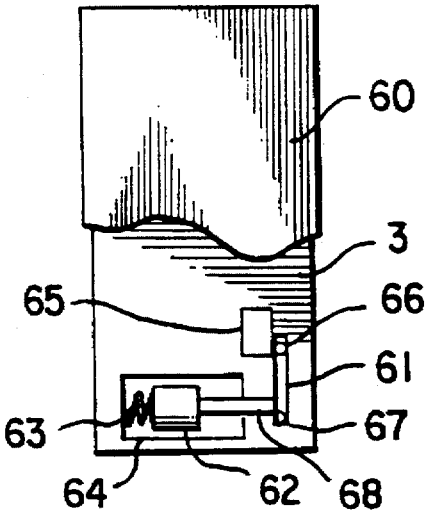

FIGS. 9(*a*) and 9(*b*) illustrate an embodiment in which a transceiver incorporating the antenna device of the present invention employs a load cell for detecting the posture of the transceiver. Thus, the load cell functions as the change-over switch 24 shown in FIG. 2. Various types of load cells 61 are available, among which a load cell of the type which changes its resistance value is used in this embodiment. Referring to FIG. 9(*a*), when the transceiver 60 is set in a laid-down position, a spring 63 incorporated in the cylinder 64 is contracted by the load of a weight 62, so that the load cell 61 is flexed as its one end is pulled by a wire 68 connected to the weight 62. The other end of load cell 61 is located on supporting substrate 65. Electrodes 66 and 67 provided on both ends of the load cell 61 are connected to an antenna circuit. The resistance value between the electrodes 66 and 67 is so determined as to enable the antenna device to function only as a magnetic field antenna.

Referring now to FIG. 9(*b*), when the transceiver 60 is set in an upright position, the load of the weight 62 is not transmitted to the wire 68 so that the load cell 61 is never flexed. In this state, a resistance value which enables the antenna device to operate as a magnetic/electric field antenna is developed between the electrodes 66 and 67. The spring 63 preferably has a large spring constant so as to suppress oscillation of the weight due to vibration.

Figure 10:
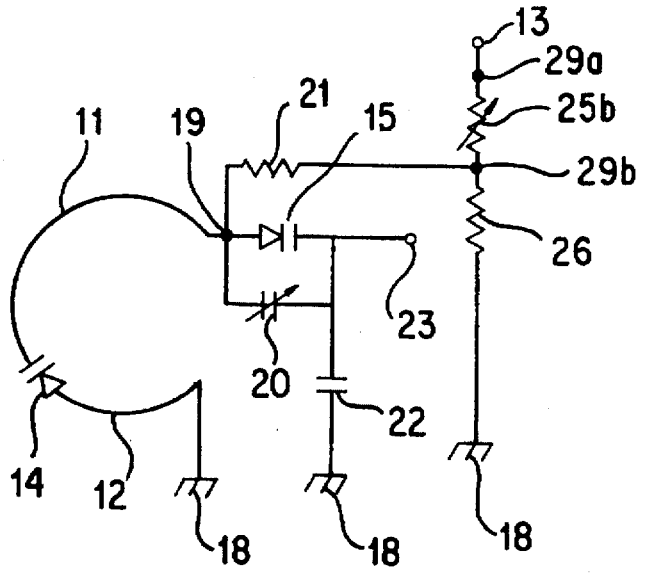
FIG. 10 is a circuit diagram showing the circuitry of the transceiver shown in FIG. 9.
Figure 11A:
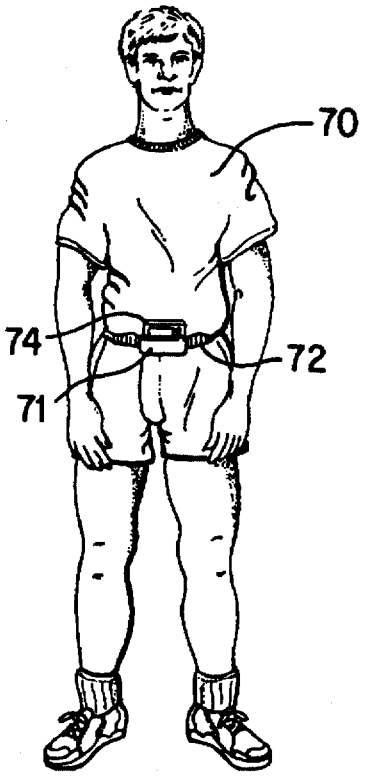
FIGS. 11(*a*) and 11(*b*) are illustrations of a transceiver equipped with an antenna device of the present invention and carried by a human body.
Figure 11B:
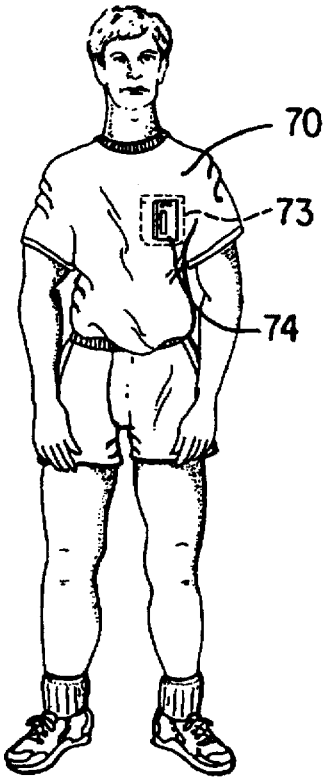

FIG. 10 illustrates the circuit of the embodiment shown in FIGS. 9(*a*) and 9(*b*). The variable resistor 25*b* corresponds to the load cell 61. The electrodes 66 and 67 correspond to the terminals 29*a* and 29*b*. FIGS. 11(*a*) and 11(*b*) illustrate an embodiment in which a transceiver incorporating the antenna device of the present invention is carried by a human body 70. More specifically, in FIG. 11(*a*), a holster 71 suspended from a waist belt 72 is used when the transceiver is to be carried in a laid-down posture, whereas, in FIG. 11(*b*), the transceiver 74 is held in a breast pocket 73 in an upright position. High sensitivity characteristic is stably obtained in both cases.

Figure 12:
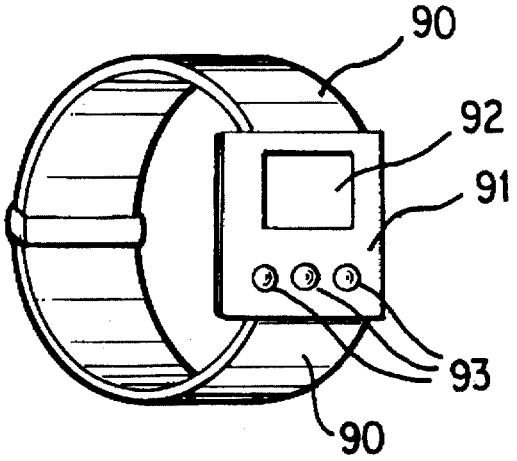
FIG. 12 is an illustration of an antenna in accordance with the present invention applied to a wrist type transceiver.

FIG. 12 illustrates an embodiment in which the loop antenna device of the present invention is incorporated in a wrist type transceiver. The loop antenna device is encased in a wrist belt 90, and a display panel 92 and a switches 93 are disposed on the front side of the main body 91.

Figure 13A:
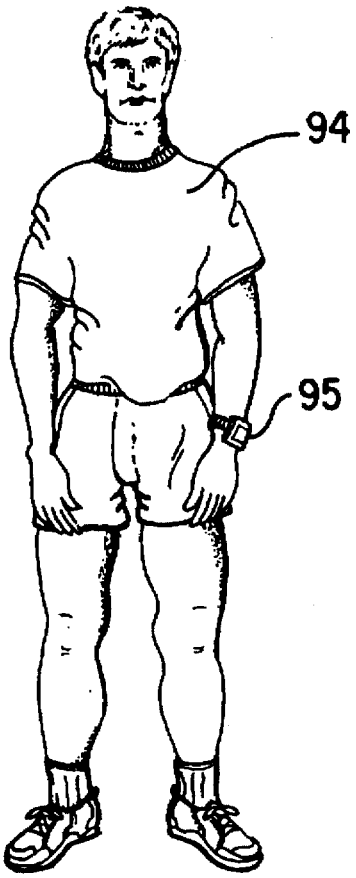
FIGS. 13(*a*) and 13(*b*) are illustrations of the transceiver of FIG. 12 carried by a human body.
Figure 13B:
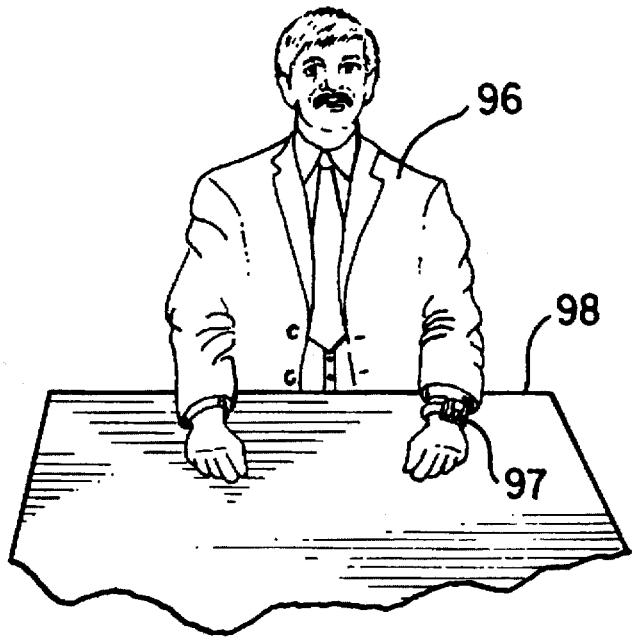

FIGS. 13(*a*) and 13(*b*) illustrate the embodiment shown in FIG. 12 carried by a human body. FIG. 13(*a*) shows the posture of the transceiver 95 obtained when the user 94 who carries the transceiver 95 is standing up or walking, whereas FIG. 13(*b*) illustrates the state of the transceiver 97 when the user 96 is seated by a table 98. It will be seen that there is a distinctive difference in the posture of the transceiver 95 between the states shown in FIGS. 13(*a*) and 13(*b*). The loop antenna device of the present invention, however, that can provide stable characteristic regardless of the posture of the transceiver.

Various embodiments of the present invention have been described. It is to be understood, however, that the described embodiments are only illustrative and the invention can be applied to transceivers which are adapted to be carried by human bodies in various postures. In addition, various forms of sensors for sensing the posture of the transceivers can be obtained by using switches sensitive to the force of gravity.

The present invention also can be applied to various other types of apparatuses other than transceivers, such as, for example, a measuring device for detecting a polarization plane of an electric wave, and a circuit for automatically removing a polarized wave component of a disturbance wave for improving anti-disturbance characteristics of transceivers.

Figure 14:
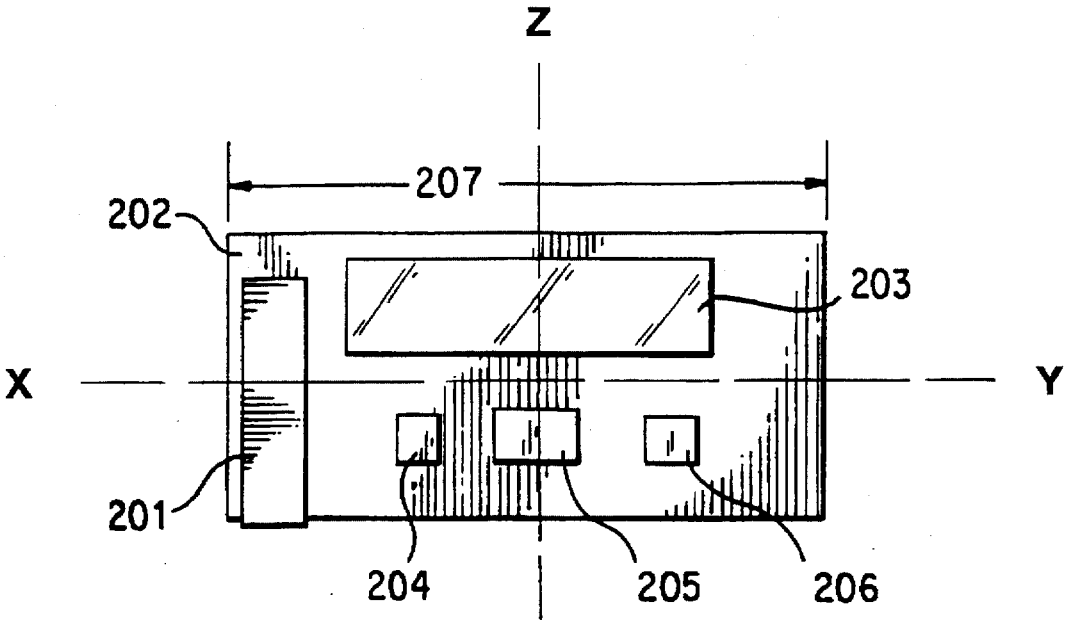
FIG. 14 is a top plan view of a circuit board on which an antenna device of the present invention is mounted.

FIGS. 14 onwards illustrate embodiments of the antenna device of the present invention designed on the basis of the length of the circuit board.

FIG. 14 is a top plan view of an antenna device of the present invention mounted on a circuit board.

A loop antenna 201, wireless transmission/receiving circuit elements 204, 205, 206, and a display panel 203 are mounted on the circuit board 202. A digital circuit portion, although not shown in the Figure, is spaced apart from both blocks or provided beneath the display panel 203 because it is liable to generate noise which may be caught by the wireless portion or the antenna.

The loop antenna 201 is formed by bending a flat plate into the form of a loop antenna. This loop antenna is disposed such that its longitudinal axis orthogonally intersects the longitudinal axis of the circuit board 202 expressed by the line X-Y. The length 207 of the circuit board 202 is determined to be about $\lambda/8$, representing the wavelength of the transmission wave by $\lambda$. The circuit board length can be selected between approximately $\lambda/6$ and $\lambda/10$.

Figure 15:
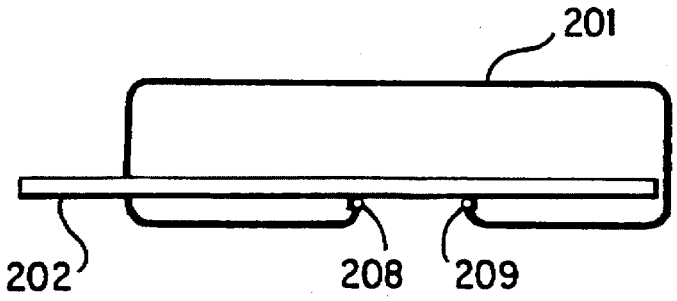
FIG. 15 is a sectional view of the antenna device shown in FIG. 14 as viewed in the direction of an arrow X.

FIG. 15 is a sectional view of the antenna portion as viewed in the direction of an X in FIG. 14.

As illustrated, the loop antenna 201 surrounds the circuit board 202 and has a length approximating $\lambda/8$. The point 208 of connection between the loop antenna 201 and the circuit board 202 is connected to the same pattern as the pattern which is held at a potential, e.g., ground level, common to circuits 203, 204, 205, 206 mounted on the circuit board 202. The other point 209 of connection is connected to a high-frequency amplifier circuit which constitutes a stage next to the antenna. The circuit board 202 has a multilayered structure having an internal layer entirely covered by a print pattern which his held at at least the ground potential.

Figure 16:
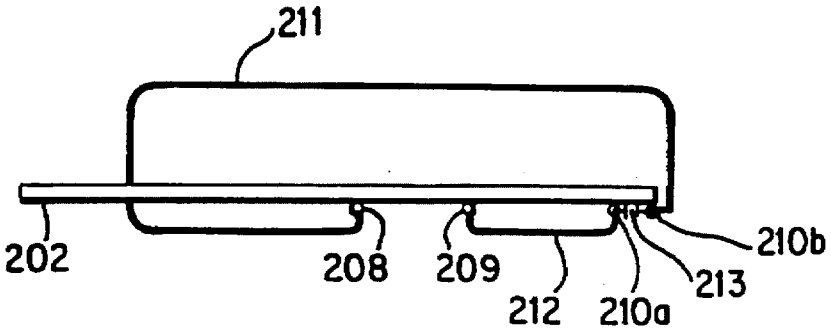
FIG. 16 is a view similar to that of FIG. 15 but showing a loop antenna device with a capacitor inserted to an intermediate portion thereof.

FIG. 16 shows a modification of the embodiment shown in FIG. 15. In this modification, the loop antenna 201 is divided into two sections: namely, a first loop portion 211 and a second loop portion 212, and a capacitor 213 is connected between the terminals 210*a* and 210*b* of both loop portions.

The capacitor 213 is inserted such that the ratio of the length between the first loop portion 211 and the second loop portion 212 is 7:1. When this ratio is large, i.e., when the length of the first loop portion 211 is comparatively large, the antenna gain is increased when this antenna performs a dipole operation. At the same time, however, such a large ratio causes a greater deviation of the impedance when the transceiver is used in the vicinity of the human body. The influence of the impedance deviation is more dominant than the increase in the gain. This undesirable effect is produced during the operation of the loop antenna 211, 212 so that the sensitivity of the transceiver is generally lowered when the transceiver is carried by the human body. For these reasons, it is not preferred to increase the above-mentioned ratio unlimitedly.

When the ratio mentioned above is comparatively small, i.e., when the length of the first loop portion 211 is comparatively small, the deviation of impedance which is caused when the transceiver has approached the human body is also small, but the antenna gain during dipole operation also is largely decreased. Consequently, the gain of the loop antenna during operation is substantially unchanged. An antenna having such a small ratio does not meet the object of the present invention because it exhibits unacceptably large difference in the sensitivity according to the azimuth of the transceiver.

According to the invention, the ratio between the first loop portion 211 and the second loop portion 212 is determined to be about 7:1, so as to ensure a sufficiently large gain during dipole operation while minimizing undersirable effect which is produced when the transceiver is used in the vicinity of a human body.

Figure 17:
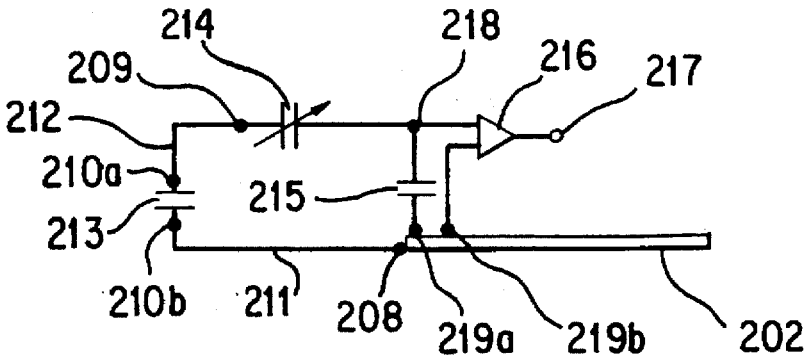
FIG. 17 is an illustration of the electrical operation of the antenna device shown in FIG. 16.

FIG. 17 is an illustration of electrical operation of the antenna shown in FIG. 16.

When the whole antenna device operates as a single loop antenna, a closed loop is formed by the first loop portion 211, the capacitor 213, the second loop antenna 212, capacitors 214, 215 and points of connection 208, 209, 210*a*, 210*b*, 218 and 219*a*, and this closed loop functions as a loop antenna. An electromotive force generated in this loop antenna, appearing as a potential difference between the connecting points 219*a* and 219*b*, is input to a high-frequency amplifier circuit 216, and the amplified voltage between point 218 and 219*b* appears at an output terminal 217. Thus, the circuit board 202 has a potential pattern which is common both to the circuit 216 and the loop antenna.

When the antenna device operates as a dipole antenna, the above-mentioned common potential pattern of the circuit board 202 serves as one of two elements of the dipole arrangement, while the other element is constituted by the first loop portion 211. Connection points 219*a*, 219*b* are located substantially midway between these two elements. The connection point 210*b* is connected to the capacitor 213 which is then connected to the second loop antenna 212. However, since the capacitor 213 has a large impedance value, the elements such as the capacitor 213, second loop portion 212 and so forth, connected to the connection point 210*b*, can be materially neglected when the whole antenna device functions as a dipole antenna.

The overall length of the dipole antenna is then expressed by $\lambda/8$ (length of circuit board) $+\lambda/8*7/8$ (length of first loop portion 211). The dipole antenna having such a length cannot be regarded as being so-called small dipole, and an appreciable current distribution is formed on the antenna. The pattern of the current distribution is similar to that of $\lambda/2$ dipole antenna.

In such a case, the impedance of the connecting points connected to the circuit 216 is low and very closely approximate the impedance matching condition of the circuit 216.

Figure 18:
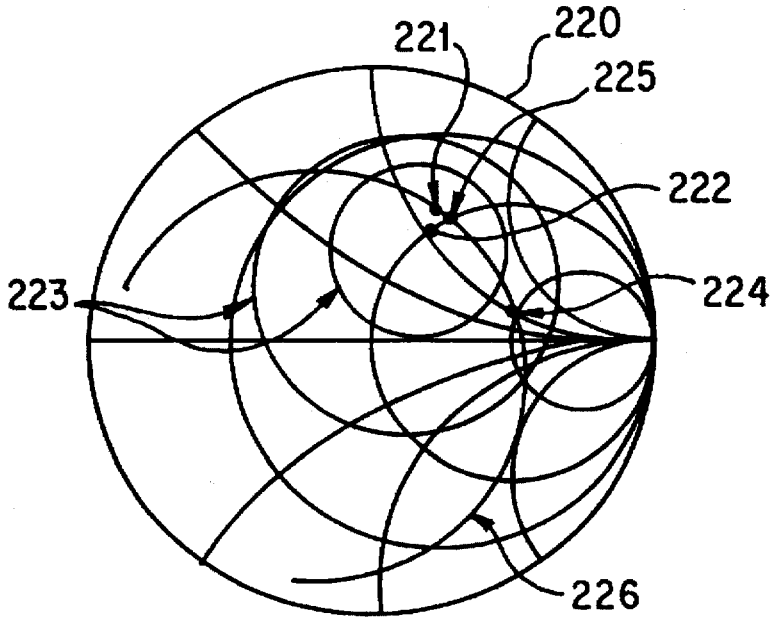
FIG. 18 is an illustration of output impedance locus of an antenna in accordance with the present invention.

FIG. 18 is a graph showing the locus of output impedance with respect to the frequency as observed in the antenna device of the present invention. More specifically, the impedance locus denoted by 226 is drawn on a Smith chart 220.

Numeral 221 designates an impedance point obtained when the antenna of FIG. 16 is adjusted for best matching by adjustment of the capacitor 214, while 222 denotes an impedance point which minimizes the noise figure in the circuit 216. Numeral 223 denotes an equi-noise index circle which interconnects impedance points of the same noise figure.

The impedance point 222 has an impedance value approximating 50+50 j (Ω). Higher matching of the transceiver is obtained when the impedance value of the point 222 approaches the above-mentioned value. When the antenna device is used as a dipole antenna, since the impedance at the power supply point is low, it is possible to approximate the impedance point without substantially necessitating impedance conversion.

This means that it is not necessary to add any specific electronic element for the purpose of conducting impedance conversion. Consequently, a compact antenna circuit which can operate with reduced loss can be obtained.

Numeral 225 designates an impedance point which is obtained when the antenna circuit of FIG. 16 has been brought close to the human body. It will be seen that this impedance point 225 is substantially the same as the impedance point 222.

Numeral 224 designates an impedance point which is obtained when the loop antenna device has been brought close to a human body with the capacitance 213 of FIG. 16 having been shifted near to the connection point 209 while omitting the second loop antenna 212. This corresponds to the case where the antenna of FIG. 15 is used. In this case, the impedance is largely deviated from the impedance point 221 so that the sensitivity is inevitably reduced.

As will be understood from these facts, the antenna device of the type shown in FIG. 16 can reduce any influence of the human body which is caused when the antenna device is used in the vicinity of the human body.

Figure 19:
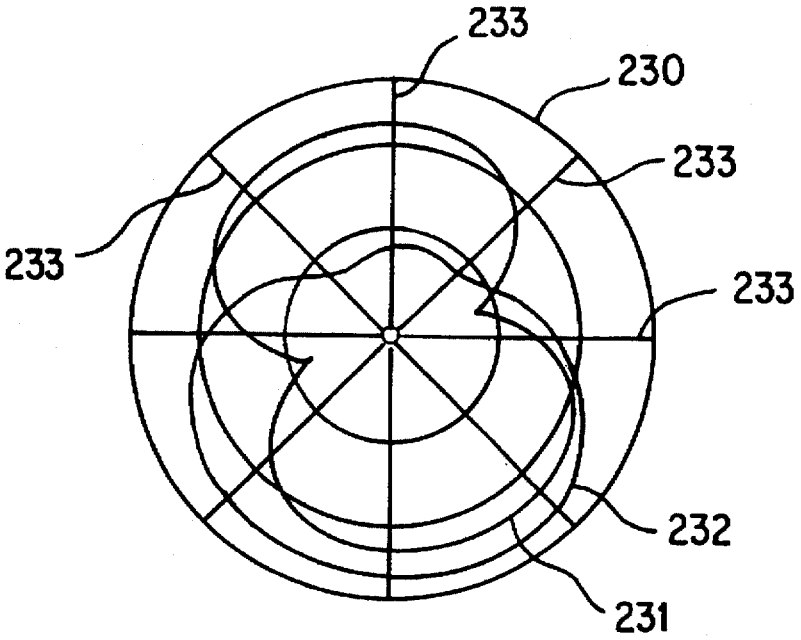
FIG. 19 is an illustration of directivity characteristics of an antenna device in accordance with the present invention.
Figure 20:
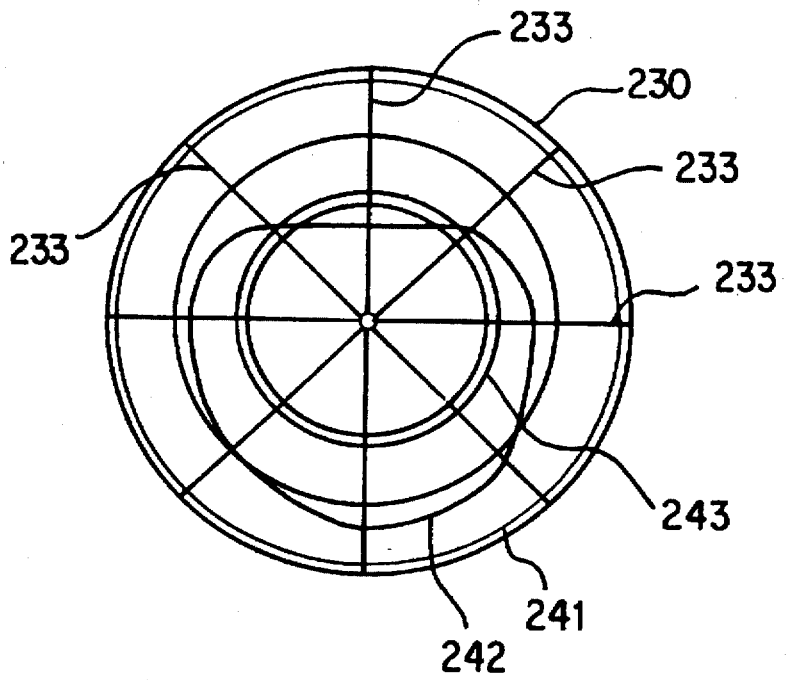
FIG. 20 is an illustration of directivity characteristics of an antenna device in accordance with the present invention.

FIGS. 19 and 20 illustrate directivity characteristics of the antenna device in accordance with the present invention. More specifically, FIG. 19 shows characteristics as observed when the antenna device is disposed such that the X-Y axis of FIG. 14 is set perpendicular to the electric field polarization plane which is vertical and rotated about the Z-axis. This state is referred to as the laid-down state. The term "front direction" is used to mean the orientation of the loop antenna device of FIG. 14 with respect to an electric wave impinging upon the antenna device in the direction normal to the plane of FIG. 14. In the laid-down position, the substrate detects the electric field of the wave with a horizontal polarization because, in this embodiment, the condition ($L1*C1 \neq L2*C2$) is satisfied. Similar to the previous embodiment, the loop detects the magnetic field of a vertical polarization wave when in the laid-down position.

In FIG. 19, using an eight-direction chart 230 having eight direction lines 233, a graph 231 shows the characteristic as observed when the transceiver is placed alone, while a graph 232 indicates the characteristic as observed when the transceiver is carried by the human body. The antenna device, when carried by the human body with its front side facing the wave, exhibits a rise of the antenna gain by several dB, by virtue of the fact that the antenna of the invention operates as a loop antenna.

FIG. 20 shows the directivity characteristic as observed when the loop antenna device is disposed such that the X-Y axis in FIG. 14 is placed in parallel with the electric field polarization plane which is vertical and rotated about the X-Y axis. This posture will be referred to as the "upright state", hereinafter. The advantage of the present invention will be best seen from FIG. 20. In this Figure, the graphs 241 and 243 show gains of the antenna disposed in a space: more specifically, the graph 241 shows the gain of the antenna of the invention as shown in FIG. 15, while the graph 243 shows the gain as obtained when the length of the loop antenna 201 in FIG. 15 is reduced to ½ or when the length of the circuit board 202 is reduced to ½ without changing the length of the loop antenna 201.

The difference between the values indicated by the graphs 241 and 243 is as large as more than 10 dB. From this fact, it is understood that, when the circuit board 202 and the loop antenna 201 are made to have lengths substantially equal to each other as in the present invention, the circuit board 202 is enabled to efficiently pick up the electric field component of the wave and to efficiently pass the received signal to the circuit 216. When the antenna of the invention has a construction of the type shown in FIG. 15, the gain of the circuit board 202 as a dipole antenna is somewhat reduced, but the undesirable effect produced by a human body can be remarkably suppressed as shown in FIG. 18 when the antenna device is positioned in the vicinity of such human body.

In FIG. 20, a graph 242, which should be contrasted to the graph 241, shows the antenna gain as obtained when the antenna is carried by the human body. In this case, the antenna device operates in a mode for picking up the electric field component, so that the sensitivity is inevitably lowered when the antenna device is held at the front side of the human body. This fact is shown also in the article which is mentioned before in the description of the related art. It is to be pointed out that the absolute level of the graph 242 is almost the same as the antenna gain as shown in FIG. 19. This means that the gain is not substantially changed regardless of the direction or orientation of the antenna device on the human body.

This feature provides an advantage specifically when the antenna device of the invention is incorporated in a portable transceiver, because in such an application the receiving sensitivity is not changed substantially regardless of the direction or orientation of the transceiver on the human body. The embodiment shown in FIG. 16 also can provide sensitivity characteristic having no substantial directivity, although the gain of the antenna body is slightly decreased.

Figure 21:
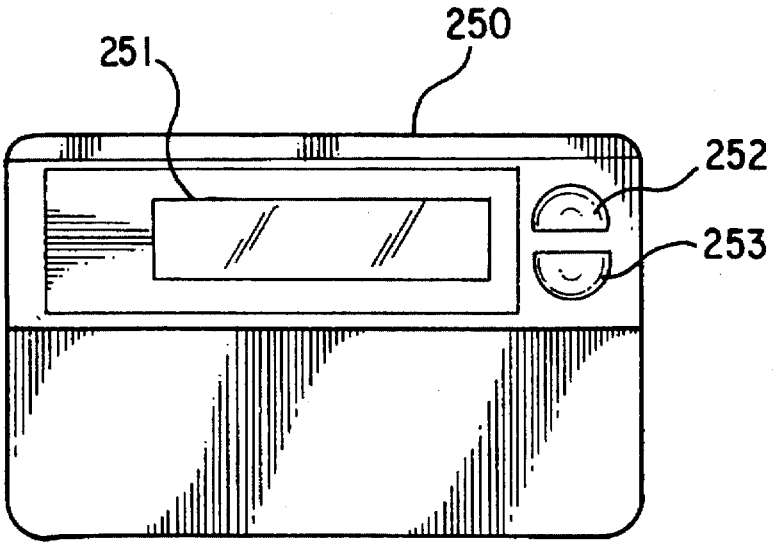
FIG. 21 shows a miniature portable wireless transceiver incorporating an antenna device in accordance with the present invention.
Figure 22A:
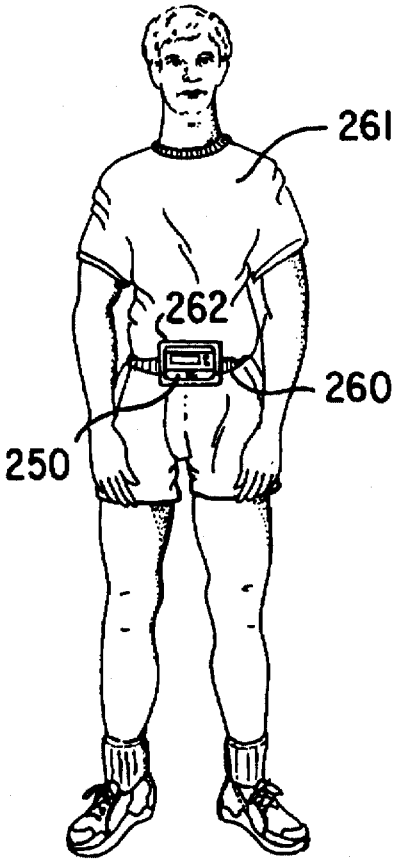
FIGS. 22(*a*) and 22(*b*) are illustrations of a miniature portable wireless transceiver of the present invention in a state mounted on a human body.
Figure 22B:
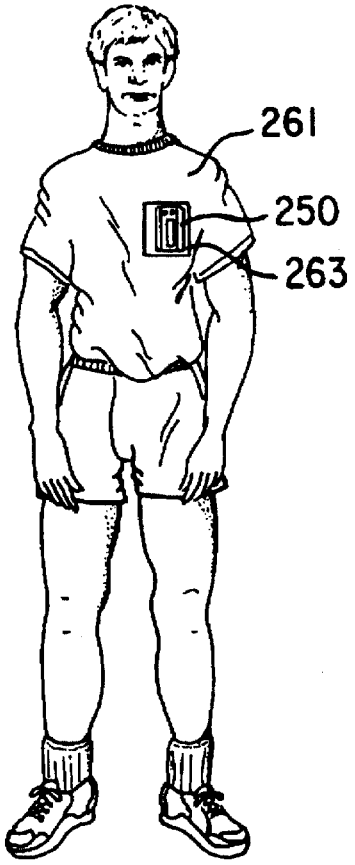

FIG. 21 illustrates a miniature portable transceiver incorporating the antenna device in accordance with the present invention. A display panel 251 is disposed horizontally. Manipulations required for confirming the display are executed while laying the transceiver in the horizontal posture as illustrated. Numerals 252 and 253 denote push-button type input switches used for the above-mentioned manipulations. The main body 250 is usually disposed in laid-down position as illustrated. For instance, the main body 250 of the transceiver is attached to a holder 262 which is positioned on a suitable portion, e.g., waist, of the user's body 261, as illustrated in FIG. 22(*a*). In this case, the main body 250 is held horizontally. Preferably, the holder 262 is mounted such that it can be tilted as desired, so as to enable easy confirmation of the content of the display without requiring demounting of the main body 250 from the holder 262, as well as easy demounting of the main body 250 from the same. The holder 262 is integral with a belt 260 so that it can easily be carried by the user's body as the belt 260 is wound around the user's waist.

When the transceiver 250 is placed in a pocket 263 near the breast, the main body 250 is held in the upright posture as shown in FIG. 22(*b*). Thus, the main body 250 is held substantially vertically.

Thus, the transceiver can be carried in any desired posture on the user's body. The main body 250 incorporating the antenna of the present invention exhibits, as explained before, a substantially constant antenna gain regardless of its posture. This feature is advantageous particularly when the transceiver is a portable transceiver which is to be carried by the user's body.

Figure 23:
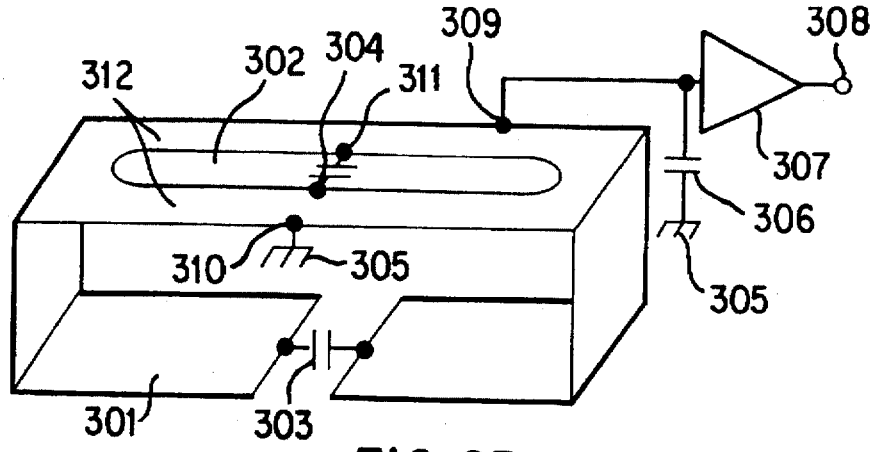
FIG. 23 is an illustration of antenna device in accordance with the present invention having a slit formed in a conductor plate of the antenna.

FIGS. 23 onwards show different embodiments of the antenna device of the present invention having specific forms of the antenna body.

More specifically, FIG. 23 shows an embodiment in which a slit is formed in a portion of the conductor plate.

The conductor plate 301 cooperates with a capacitor 303 in forming a loop antenna. The conductor plate 301 is partly slitted as at 302. A capacitor 304 is disposed at any desired position within the slit 302 so as to interconnect connection points 310 and 311. The connection point 310 is connected to the ground 305. A power supply point 309 is disposed at any desired position on the conductor plate 312 which extends in parallel with the slit 302. The conductor plate 312 is connected to a high-frequency amplifier circuit 307 through the power supply point 309 and a capacitor 306 for obtaining matching of the antenna circuit. The output of the circuit 307 is connected through a terminal 308 to a component of a subsequent stage such as an intermediate-frequency circuit. The capacitor 303 is positioned so as to confront the slit 302.

This type of antenna, having a conductor plate provided with a slit across which the power is supplied is generally referred to as "slot antenna". The antenna of this embodiment is characterized in that a part of a conductor plate which forms a loop antenna functions also as a slot antenna.

The characteristic feature of the slot antenna resides in that it can efficiently detect the magnetic field component of the direction in which the slit extends. The antenna shown in FIG. 23, therefore, can detect also a magnetic field component of a direction orthogonal to the direction of the magnetic field detected by the loop antenna.

Figure 24:
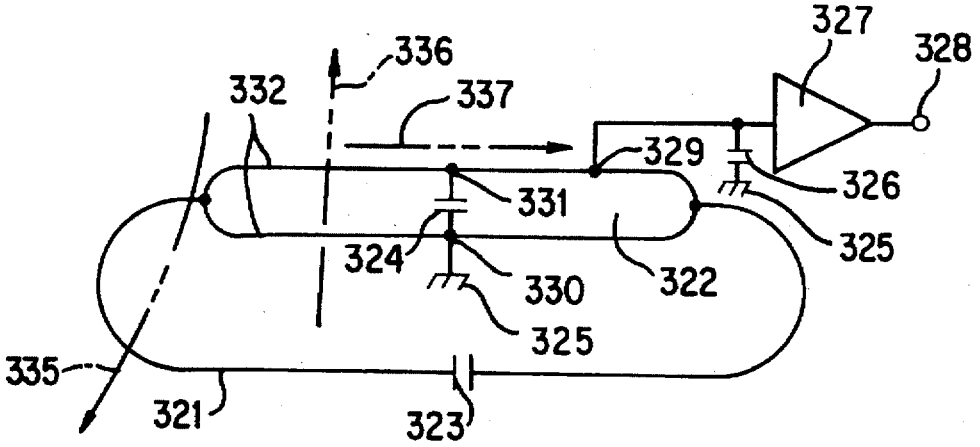
FIG. 24 is a simple illustration of magnetic field components which can be detected by an embodiment of the present invention.

FIG. 24 schematically illustrates the directions of the magnetic field components which can be detected by the embodiment shown in FIG. 23. The loop antenna constituted by the conductor plates 321, 332 and the capacitor 323 detects a magnetic field component 335. A slot antenna constituted by the slit 322 and the capacitor 324 detects a magnetic field component 337. Furthermore, a magnetic field component 336 is detected by a loop antenna which is constituted by the conductor plate 332 surrounding the slit 322 and the capacitor 324 when the positions of the connection points 330 and 331 are suitably selected along the slit 322. As described in connection with FIG. 23, the antenna device in FIG. 24 also includes a high-frequency amplifier circuit 327 connected to conductor plate 332 at a power supply point 329 and a capacitor which is connected to ground 325. Circuit 327 includes an output terminal 328.

The magnetic field components 335, 336 and 337 are orthogonal to one another, so that they can be detected by the antenna device of the present invention regardless of the posture of the antenna device. This feature is quite advantageous for transceivers which are intended to be carried on the user's body during the use.

Figure 25:
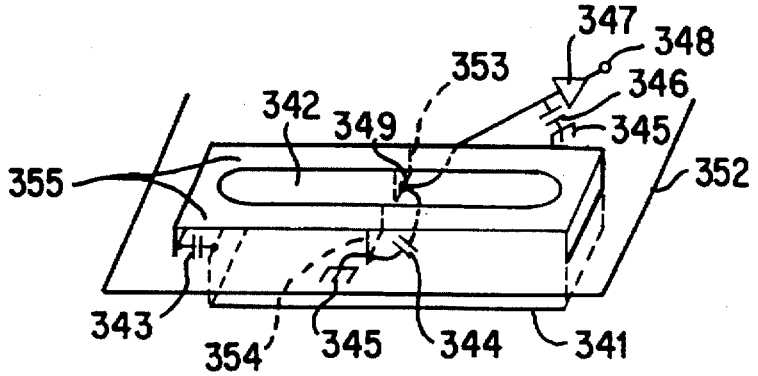
FIG. 25 is an illustration of an antenna device of the present invention mounted on a circuit board.

FIG. 25 illustrates the antenna device of this embodiment mounted on a circuit board. A conductor plate 341 is mounted on the circuit board which is denoted by 352. Capacitors 343, 344, 346 and a circuit 347 are indicated by symbols which are used in ordinary electric circuit diagrams. In this arrangement, the capacitor 343 is disposed so as not to oppose the slit 342. A conductor plate 355 and a circuit board 352 are connected to each other through conductor plates 353, 354. The conductor plate 353 is for the supply of electrical power via power supply point 349, while the conductor plate 354 is for grounding to ground 345. Thus, the conductor plate 353 and the conductor plate 354 respectively correspond to the connection points 329, 330 and the connection point 331, respectively. Circuit 347 includes output terminal 348.

Figure 26:
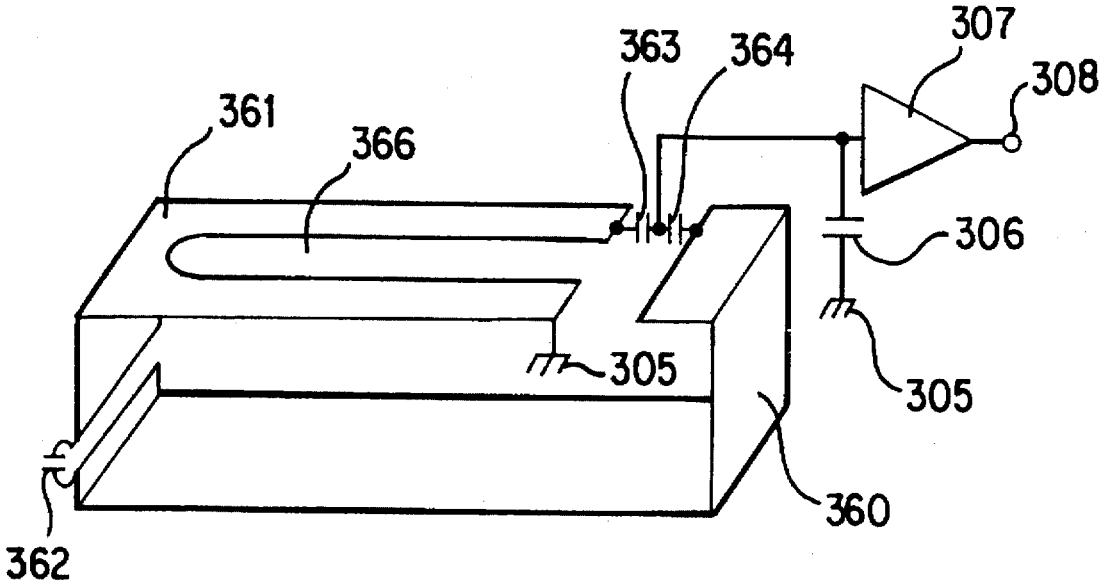
FIG. 26 is an illustration of a different embodiment of the antenna in accordance with the present invention.

FIG. 26 shows a different embodiment which also is of the type having a slitted conductor plate. In this embodiment, however, the slit 366 is opened at its one end and a capacitor 362 is provided. In this embodiment, therefore, a loop antenna is formed by a pair of conductor plates 360, 361, capacitors 363, 364 and the capacitor 362.

Figure 27:
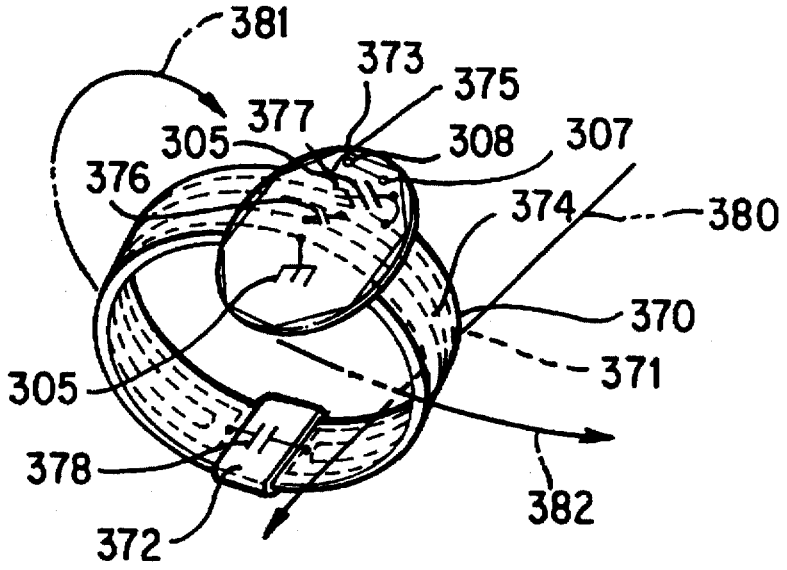
FIG. 27 is an illustration of an antenna device of the present invention applied to a wrist type transceiver.

This antenna device may be incorporated in a transceiver of the type shown in FIG. 21 or in a wrist type transceiver as shown in FIG. 27. The transceiver shown in FIG. 27 has a conductor plate 371 which extends through a wrist band 370. A slit 374 is formed so as to extend in parallel with the longitudinal axis of the wrist band 370 substantially over the entire length of the conductor plate 370. The opposing ends of the internal conductor plate 371 are connected to each other through a connector 372 having a capacitor 378, so that the antenna has the form of a loop both in appearance and electrical function.

The main body 373 of the transceiver has a circuit board 375 onto which is extended a pattern leading from the conductor plate 371. The pattern is composed of a pair of parallel conductor strips or plates separated from each other by a slit. Capacitors 376, 377 and a high-frequency amplifier circuit 307 are mounted on the circuit board 375. Electrical connections are materially the same as those in FIG. 23.

Directivity characteristics somewhat different from those obtained from the embodiment of FIG. 23 are obtained when the embodiment of FIG. 26 is used in a wrist type transceiver shown in FIG. 27. Namely, the transceiver of FIG. 27 is different from that shown in FIG. 23 in that the slot antenna is curved in the form of a loop. This specific form of the slot antenna enables detection of all the magnetic field components of the directions extending long the slit, as indicated by an arrow 381. Numeral 382 designates a magnetic field component which corresponds to the magnetic field component 336 of FIG. 24. Numeral 380 designates a magnetic field component which corresponds to the magnetic field component 335 of FIG. 24. These magnetic field components are detectable because the antenna device seemingly has the form of an elongated loop antenna when viewed in all these directions. These bidirectional components provide a uniform directivity characteristic having no null point, which is quite convenient for portable transceivers.

Figure 28:
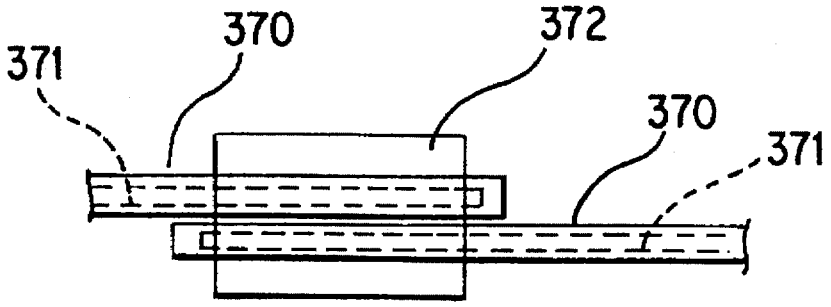
FIG. 28 is a sectional view illustrative of the electric characteristics of a connector for attaching and detaching the wrist band of the transceiver shown in FIG. 27.

FIG. 28 is the cross-sectional view illustrative of the electric characteristics of a connector for attaching and detaching the wrist band of the transceiver shown in FIG. 27. The opposing ends of the internal conductor plate 371, which extend through the wrist band 370, are connected to each other through the connector 372. The connected portion has an electric capacity because the conductive plates are overlapped in parallel. With this structure, a loop antenna can be formed with a conductive plate 371.

Figure 29:
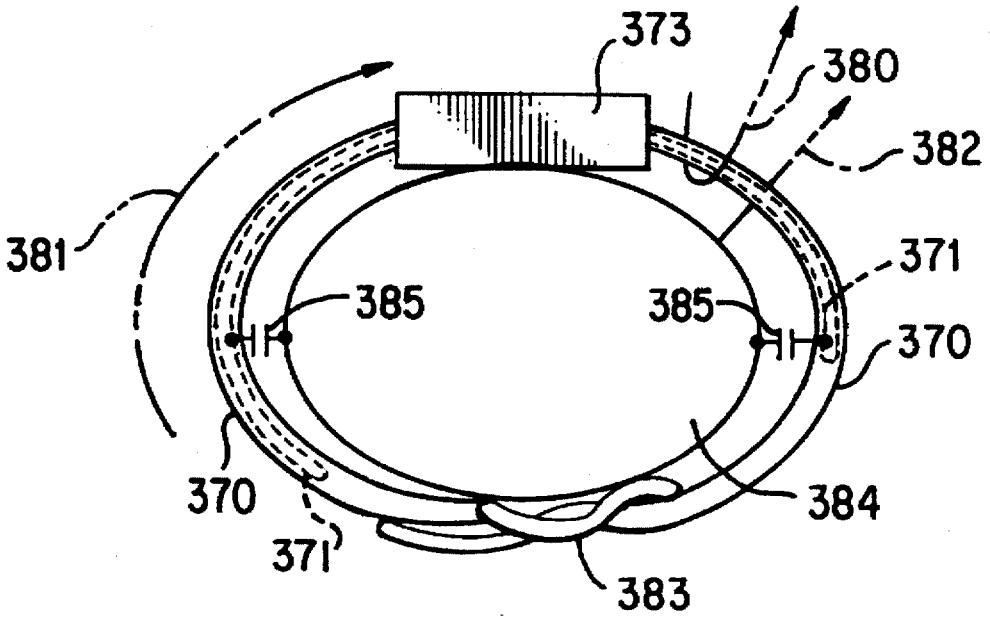
FIG. 29 is illustration of an antenna device of the present invention which does not use a connector as an electric circuit but utilizes an arm as a capacitor.
Figure 30:
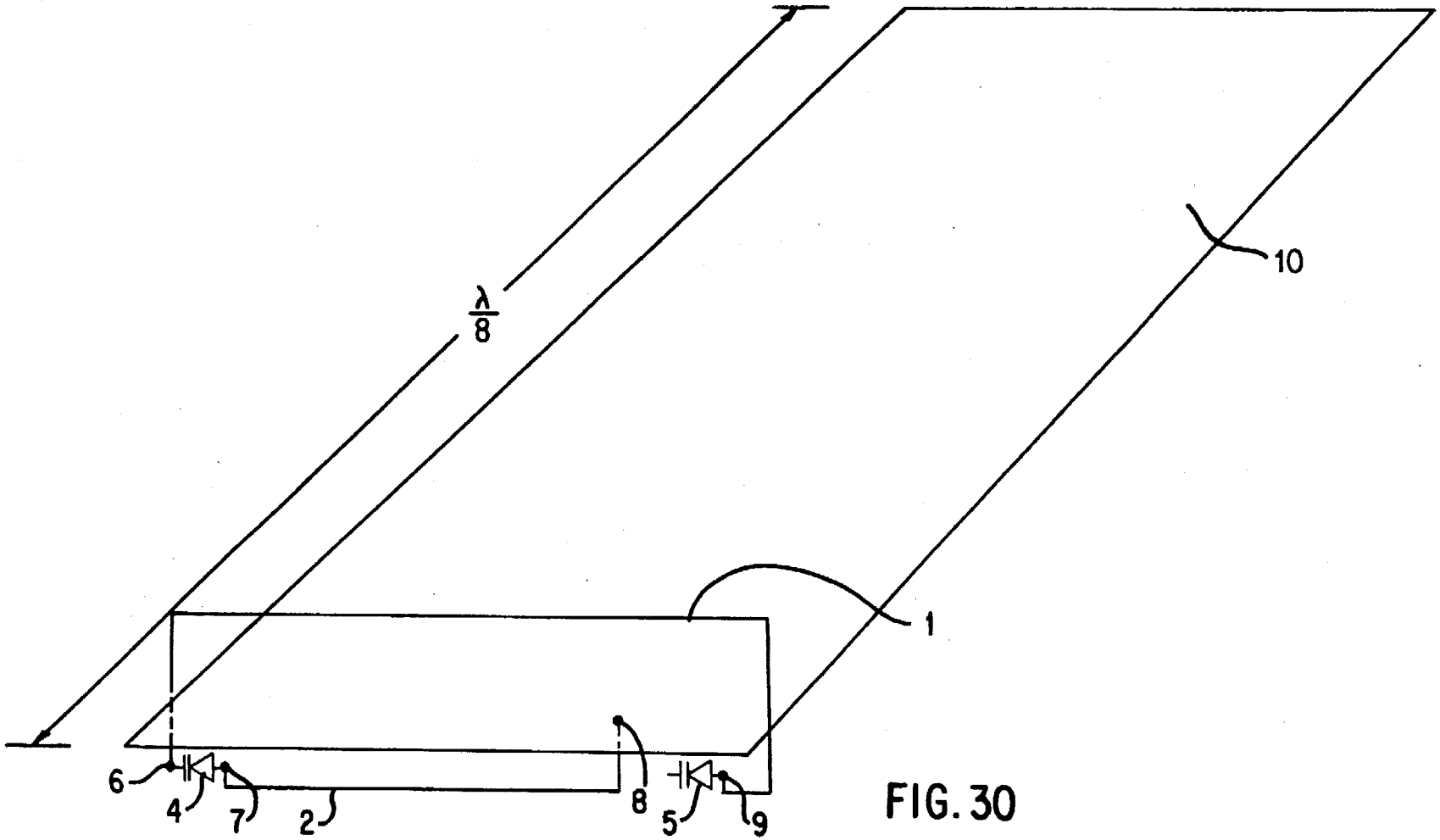
FIG. 30 shows perspectively and schematically the antenna device of FIG. 1. The first loop antenna 1 and the second antenna loop antenna are connected through a second variable capacitor element 4 at points 6 and 7. The second antenna 2 is connected at connecting point 8 to an interprinted pattern 10 which has a length of $\lambda/8$ where $\lambda$ is the wavelength of a received frequency. The other terminal of the first loop antenna 1 is connected to a first variable capacitance element at connecting point 9. Thus, the first loop antenna 1 and the second loop antenna 2 connected through the variable capacitance element 4 forms a single loop antenna.

FIG. 29 illustrates a modification of the embodiment of FIG. 27, in which the electric circuit omits the connector and utilizes the user's arm as an antenna. More specifically, this modification utilizes a buckle 383 in place of the connector 372 used in the embodiment of FIG. 27. Thus, in the modification shown in FIG. 29, the connector portion is required only to provide a mechanical connection of the wrist band, without providing any electrical connection. The wrist band 370 is disposed near an arm 384 of the user so that a capacitance 385 is formed between the conductor plate 371 and the arm 384. The capacitance 385, arm 384 and the conductor plate 371 form a loop antenna. The antenna device of this modification can detect magnetic field components 380, 381 and 381, so that antenna gain can be obtained regardless of the direction of the arm 384. The magnetic field distribution on a human arm has not been clarified yet but it is clear that the antenna device shown in FIG. 29 makes an effective use of the magnetic field components on the human arm so as to exhibit an improvement in the gain.

Thus, the transceivers incorporating the antenna device of the present invention always exhibit stable transmission/receiving characteristics.

What is claimed is:

1. A loop antenna device for use in a portable apparatus having said loop antenna device, at least one of a transmission circuit and a receiving circuit, a data decoder, a CPU, a data display means and an informing circuit, said portable apparatus having a horizontal position and a vertical position, said loop antenna device comprising:

a first loop portion having a first terminal connected to a first variable capacitance means and a second terminal connected to a first terminal of a second variable capacitance means; and a second loop portion forming a loop antenna with the first loop portion, said loop antenna detecting a magnetic field component of an electromagnetic wave, said second loop portion having a first terminal connected to a second terminal of said second variable capacitance means and a second terminal connected to a high-frequency grounded surface, said high-frequency grounded surface having a rectangular form, a plane of the loop antenna being substantially parallel to a shorter side of said high-frequency grounded surface and substantially perpendicular to a longer side of said high-frequency grounded surface, said grounded surface detecting the electric field component of the electromagnetic wave, said first loop portion and said second loop portion being spaced away from said grounded surface between the first and second terminals of said first and second loop portions, wherein when said portable apparatus is in the horizontal position, a ratio of a capacitance of the second variable capacitance means to a capacitance of said first variable capacitance means is substantially equal to a ratio of a length of said first loop portion to a length of said second loop portion of said loop antenna.

2. A loop antenna device according to claim 1, wherein each of said first and second variable capacitance means is adapted to change its capacitance as a result of application of a voltage across said variable capacitance means, said loop antenna device further comprising means for applying a voltage across said variable capacitance means.

3. A loop antenna device according to claim 2, wherein said means for applying a voltage varies said voltage in accordance with a posture of said portable apparatus.

4. A loop antenna device according to claim 3, wherein said means for applying a voltage includes a switch which changes said voltage in accordance with the posture of said portable apparatus.

5. The loop antenna device according to claim 3, wherein the means for applying voltage increases a voltage applied to the second capacitance means and decreases a voltage applied to the first capacitance means when the antenna device is changed from the horizontal to the vertical position.

6. The loop antenna device according to claim 1, wherein the portable apparatus is a receiver.

7. The loop antenna device according to claim 1, wherein the portable apparatus is a transmitter.

8. The loop antenna device according to claim 1, wherein the portable apparatus is a transceiver.

9. A portable apparatus having a loop antenna device, said portable apparatus having a horizontal position and a vertical position, said loop antenna device comprising:

a first loop portion having a first terminal connected to a first variable capacitance means and a second terminal connected to a first terminal of a second variable capacitance means; and a second loop portion forming a loop antenna with the first loop portion, said loop antenna detecting a magnetic field component of an electromagnetic wave, said second loop portion having a first terminal connected to a second terminal of said second variable capacitance means and a second terminal connected to a high-frequency grounded surface, said high-frequency grounded surface having a rectangular form, a plane of the loop antenna being substantially parallel to a shorter side of said high-frequency grounded surface and substantially perpendicular to a longer side of said high-frequency grounded surface, said high-frequency grounded surface detecting the electric field component of the electromagnetic wave, said first loop portion and said second loop portion being spaced away from said grounded surface between the first and second terminals of said first and second loop portions, wherein when said portable apparatus is in the horizontal position, a ratio of a capacitance of the second variable capacitance means to a capacitance of said first variable capacitance means is substantially equal to a ratio of a length of said first loop portion to a length of said second loop portion of said loop antenna.

10. The portable apparatus according to claim 9, wherein the portable apparatus is a transceiver.

11. The portable apparatus according to claim 9, wherein the portable apparatus is a receiver.

12. The portable apparatus according to claim 9, wherein the portable apparatus is a transmitter.

13. A loop antenna device for use in a portable apparatus having said loop antenna device, at least one of a transmission circuit and a receiving circuit, a data decoder, a CPU, a data display means and an informing circuit which are encased in a casing, said loop antenna device comprising:

a board being substantially rectangular having a width and a length, and having an inner printed pattern spreading over substantially an entire area of said board and mounting a circuit for operating said portable apparatus, the length of said board ranging between approximately 1/10 and approximately 1/6 a wavelength of a wave, said wave being at least one of a transmitted wave and a received wave, said board capable of detecting a component of the wave; and a loop antenna having a first terminal and a second terminal mounted on said board, a plane of said loop antenna being substantially parallel to the width of the said board and substantially perpendicular to said length of said board, said loop antenna having a length between said first and second terminals ranging between approximately 1/10 and approximately 1/6 the wavelength of the wave.

14. A loop antenna device according to claim 13, wherein said loop antenna is divided at a position which is between 6:1 and 8:1 of an overall length of said loop antenna into a first loop portion having a greater length than a second loop portion, said first loop portion being connected at a first terminal to a common potential pattern of said portable apparatus and at a second terminal to a first terminal of said second loop portion through a capacitive reactance means.

15. A loop antenna device according to claim 14, wherein the length of said board is nearly equal to the sum of lengths of said first loop portion and said second loop portion.

16. A loop antenna device according to claim 13, wherein said loop antenna has a length substantially equal to the length of said board.

17. A portable apparatus having a loop antenna device, said loop antenna device comprising:

a board, said board being substantially rectangular, having a width and a length, having an inner printed pattern spreading over substantially an entire area of said board, and mounting a circuit for operating said portable apparatus, the length of said board ranging between approximately 1/10 and approximately 1/6 a wavelength of a wave, the wave being at least one of a transmitted wave and a received wave, said board capable of detecting a component of the wave; and a loop antenna having a first terminal and a second terminal mounted on said board, a plane of said loop antenna being substantially parallel to the width of said board and substantially perpendicular to said length of said board, said loop antenna having a length between said first and second terminals ranging between approximately 1/10 and approximately 1/6 the wavelength of the wave, wherein said loop antenna length is nearly equal to the length of said board.

18. The portable apparatus according to claim 17, wherein the portable apparatus is a transceiver.

19. The portable apparatus according to claim 17, wherein the portable apparatus is a receiver.

20. The portable apparatus according to claim 17, wherein the portable apparatus is a transmitter.

21. A portable apparatus having a loop antenna device, said loop antenna device comprising:

a board, said board being substantially rectangular, having a width and a length, having an inner printed pattern spreading over substantially an entire area of said board, and mounting a circuit for operating said portable apparatus, the length of said board ranging between approximately 1/10 and approximately 1/6 a wavelength of a wave, the wave being at least one of a transmitted wave and a received wave, said board capable of detecting a component of the wave; and a loop antenna having a first loop terminal and a second loop terminal mounted on said board, a plane of said loop antenna being substantially parallel to the width of said board and substantially perpendicular to said length of said board, said loop antenna having a length between said first and second loop terminals ranging between approximately 1/10 and approximately 1/6 the wavelength of the wave, said loop antenna being divided at a position which is between 6:1 and 8:1 of an overall length of said loop antenna into a first loop portion having a greater length than a second loop portion, said first loop portion being connected at first loop terminal to a common potential pattern of said portable apparatus through a first capacitive reactance element and at a second terminal to a first terminal of said second loop portion through a second capacitive reactance element, and wherein the length of said board is substantially equal to the sum of a length of said first loop portion between said first loop terminal and said second terminal and a length of said second loop portion between said first terminal of said second loop portion and said second loop portion.

22. The portable apparatus according to claim 21, wherein the portable apparatus is a transceiver.

23. The portable apparatus according to claim 21, wherein the portable apparatus is a receiver.

24. The portable apparatus according to claim 21, wherein the portable apparatus is a transmitter.

25. A loop antenna device for use in a portable apparatus having a loop antenna device and a wireless circuit, wherein said loop antenna device includes a loop antenna having a longitudinal slit that forms a first conductor plate and a second conductor plate of the loop antenna, said longitudinal slit detecting a magnetic field component of a wave that is orthogonal to the magnetic field detected by said loop antenna, said wave being at least one of a transmitted wave and a received wave;

a capacitive reactance means that interconnects first and second points located respectively on the first and second conductor plates, the first and second points opposing each other across the longitudinal slit; and a feeding point on a portion of one of the first and second conductor plates, said portion located adjacent to the longitudinal slit.

26. A loop antenna device for use in a portable apparatus having said loop antenna device and a wireless circuit, said loop antenna device including: a loop antenna having a longitudinal slit that forms a first conductor plate and a second conductor plate of the loop antenna, said longitudinal slit detecting a magnetic field component of a wave that is orthogonal to the magnetic field detected by said loop antenna, said wave being at least one of a transmitted wave and a received wave, said first conductor plate being connected to a common potential pattern of the wireless circuit; and a capacitive reactance means which interconnects first and second points located respectively on the first and second conductor plates, the first and second points opposing each other across the longitudinal slit.

27. A loop antenna device according to claim 26, wherein the second conductor plate is connected to a high-frequency input terminal of said wireless circuit.

28. A loop antenna device according to claim 27, further comprising a second capacitive reactance means attached between first and second ends of said conductor plates.

29. A loop antenna device according to claim 28, wherein the first and second ends of said conductor plates are connected by said second capacitive reactance means to form a plane that is parallel to a plane containing the slit having the second capacitive reactance means, said first and second capacitive reactance means are disposed on said loop antenna device at positions opposite to each other with respect to a center of said longitudinal slit.

30. A miniature portable apparatus having a loop antenna device comprising:

a conductor plate having a longitudinal slit to form a first and second side, said longitudinal slit detecting a magnetic field component of a wave that is orthogonal to the magnetic field detected by said loop antenna device;

a capacitive reactance means which interconnects said first and second side, wherein said first side is connected to a common potential pattern of a wireless circuit, said circuit being at least one of a transmission circuit and a receiving circuit, the second side is connected to a high-frequency input terminal of said wireless circuit; and a second capacitive reactance means attached between first and second ends of said conductor plate forming a plane parallel to a plane containing the first and second side, and wherein said first and second capacitive reactance means are disposed on said loop antenna device at positions opposite to each other with respect to a center of said slit.

31. The miniature portable apparatus according to claim 30, wherein the portable apparatus is a transceiver.

32. The miniature portable apparatus according to claim 30, wherein the portable apparatus is a receiver.

33. The miniature portable apparatus according to claim 30, wherein the portable apparatus is a transmitter.

34. A portable apparatus having a loop antenna device, said loop antenna device comprising:

a board, said board being substantially rectangular, having an inner printed pattern spreading over substantially an entire area of said board, and mounting a circuit for operating said portable apparatus, said board having a length and a width, said length being longer than said width, said board capable of detecting a component of a wave, said wave being at least one of a received wave and a transmitted wave; and a loop antenna having a first terminal and a second terminal mounted on said board, a plane of said loop antenna being substantially parallel to said width of said board and substantially perpendicular to said length of said board, a length of said loop antenna between said first and second terminals is substantially equal to the length of said board.

35. A portable apparatus having an antenna device, said antenna device comprising:

a board, said board being substantially rectangular, having an inner printed pattern spreading over substantially an entire area of said board, and mounting a circuit for operating said portable apparatus, said board having a length and a width, said length being longer than said width, said length ranging between approximately 1/10 and approximately 1/6 a wavelength of a wave, said wave being at least one of a transmitted wave and a received wave, said board capable of detecting a component of the wave.

36. A portable apparatus having a loop antenna device, said portable apparatus having a horizontal position and a vertical position, said loop antenna device comprising:

a first loop portion having a first terminal connected to a first capacitor and a second terminal connected to a high-frequency grounded surface, said first loop portion having a first inductance forming a first LC resonance circuit with said first capacitor;

a second loop portion forming a loop antenna with said first loop portion, said second loop portion having a first terminal connected to a second capacitor and a second terminal connected to said first capacitor, said second loop portion having a second inductance forming a second LC resonance circuit with said second capacitor, said first loop portion and said second loop portion being spaced away from said grounded surface between the first and second terminals of said first and second loop portions, said high-frequency grounded surface having a rectangular form, a plane of the loop antenna being substantially parallel to a shorter side of said high-frequency grounded surface and substantially perpendicular to a longer side of said high-frequency grounded surface; and wherein said high-frequency grounded surface detects at least one of a received wave and a transmitted wave when a value of the first LC resonance circuit is different than a value of the second LC resonance circuit, and when said portable apparatus is in the horizontal position, a ratio of a capacitance of the second variable capacitance means to a capacitance of said first variable capacitance means is substantially equal to a ratio of a length of said first loop portion to a length of said second loop portion of said loop antenna.

* * * * *